US011255577B2

(12) United States Patent
Noh et al.

(10) Patent No.: US 11,255,577 B2
(45) Date of Patent: Feb. 22, 2022

(54) LINEAR COMPRESSOR

(71) Applicant: LG Electronics Inc., Seoul (KR)

(72) Inventors: Kiwon Noh, Seoul (KR); Jungsik Park, Seoul (KR); Kyunyoung Lee, Seoul (KR); Jongwoo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 257 days.

(21) Appl. No.: 16/457,543

(22) Filed: Jun. 28, 2019

(65) Prior Publication Data

US 2020/0003201 A1 Jan. 2, 2020

(30) Foreign Application Priority Data

Jun. 29, 2018 (KR) ..... 10-2018-0075732

(51) Int. Cl.

| | |
|---|---|
| ***F25B 1/02*** | (2006.01) |
| ***F04B 35/04*** | (2006.01) |
| ***F04B 39/00*** | (2006.01) |
| ***F04B 39/12*** | (2006.01) |

(52) U.S. Cl.

CPC ..... *F25B 1/02* (2013.01); *F04B 35/045* (2013.01); *F04B 39/0055* (2013.01); *F04B 39/121* (2013.01); *F04B 39/122* (2013.01); *F04B 35/04* (2013.01); *F25B 2309/001* (2013.01); *F25B 2400/073* (2013.01)

(58) Field of Classification Search

CPC .... F04B 35/04; F04B 35/045; F04B 39/0055; F04B 39/121; F04B 39/122; F25B 1/02; F25B 2400/073; F25B 2309/001

See application file for complete search history.

(56) References Cited

U.S. PATENT DOCUMENTS

| | | | | |
|---|---|---|---|---|
| 4,750,871 | A * | 6/1988 | Curwen | F04B 35/045 417/320 |
| 7,213,405 | B2 * | 5/2007 | Shapiro | F25B 41/22 62/228.3 |
| 8,057,200 | B2 * | 11/2011 | Kang | F04B 39/0055 417/540 |
| 9,004,885 | B2 | 4/2015 | Ki et al. | |
| 9,022,757 | B2 * | 5/2015 | Shin | F04C 23/008 418/55.1 |
| 9,388,806 | B2 * | 7/2016 | Lee | F04B 39/122 |

(Continued)

FOREIGN PATENT DOCUMENTS

| | | |
|---|---|---|
| EP | 3196460 | 7/2017 |
| EP | 3242023 | 11/2017 |

(Continued)

OTHER PUBLICATIONS

Extended European Search Report in European Application No. 19183159.3, dated Sep. 27, 2019, 9 pages.

*Primary Examiner* — Christopher S Bobish
(74) *Attorney, Agent, or Firm* — Fish & Richardson P.C.

(57) ABSTRACT

Provided is a linear compressor. Provided is a linear compressor. The linear compressor includes a shell defining an internal space, a compressor body disposed in the internal space, and a passage guide disposed between the shell and the compressor body. The passage guide may include a first guide part extending along an inner surface of the shell in an axial direction and a second guide part extending from the first guide part to the compressor body in a radial direction.

20 Claims, 13 Drawing Sheets

(56) References Cited

U.S. PATENT DOCUMENTS

| | | | | |
|---|---|---|---|---|
| 9,850,893 | B2 * | 12/2017 | Ki | F04B 39/0033 |
| 10,036,374 | B2 * | 7/2018 | Lee | F04B 39/0027 |
| 10,598,175 | B2 * | 3/2020 | Kang | F04B 35/045 |
| 2005/0175473 | A1 * | 8/2005 | Park | F04B 39/121 417/363 |
| 2007/0110600 | A1 * | 5/2007 | Park | F04B 39/0016 417/417 |
| 2007/0148018 | A1 * | 6/2007 | Her | F04B 35/045 417/417 |
| 2012/0020819 | A1 | 1/2012 | Han et al. | |
| 2016/0003253 | A1 * | 1/2016 | Lee | F04C 18/0215 417/420 |
| 2017/0002808 | A1 * | 1/2017 | Gong | F04B 39/0238 |
| 2019/0234391 | A1 * | 8/2019 | Noh | H02K 33/14 |

FOREIGN PATENT DOCUMENTS

| | | |
|---|---|---|
| KR | 1020170124908 | 11/2017 |
| KR | 1020180040791 | 4/2018 |

* cited by examiner

LINEAR COMPRESSOR

CROSS-REFERENCE TO RELATED APPLICATIONS

The present application claims priority under 35 U.S.C. 119 and 35 U.S.C. 365 to Korean Patent Application No. 10-2018-0075732 (filed on 29 Jun. 2018), which is hereby incorporated by reference in its entirety.

BACKGROUND

The present disclosure relates to a linear compressor.

In general, compressors are machines that receive power from a power generation device such as an electric motor or a turbine to compress air, a refrigerant, or various working gases, thereby increasing a pressure. Compressors are being widely used in home appliances or industrial fields.

Compressors are largely classified into reciprocating compressors, rotary compressors, and scroll compressors.

In such a reciprocating compressor, a compression space, in which a working gas is suctioned or discharged, is provided between a potion and a cylinder so that a refrigerant is compressed while the piston linearly reciprocates within the cylinder.

In addition, in such a rotary compressor, a compression space, in which a working gas is suctioned or discharged, is provided between a roller that rotates eccentrically and a cylinder so that a refrigerant is compressed while the roller rotates eccentrically along an inner wall of the cylinder.

In addition, in such a scroll compressor, a compression space, in which a working gas is suctioned and discharged, is provided between an orbiting scroll and a fixed scroll so that a refrigerant is compressed while the orbiting scroll rotates along the fixed scroll.

In recent years, a linear compressor, which is directly connected to a driving motor, in which a piston linearly reciprocates, to improve compression efficiency without mechanical losses due to motion conversion and has a simple structure, is being developed.

The linear compressor suctions and compresses a refrigerant within a sealed shell while a piston linearly reciprocates within the cylinder by a linear motor and then discharges the compressed refrigerant.

Here, the linear motor is configured to allow a permanent magnet to be disposed between an inner stator and an outer stator. The permanent magnet is driven to linearly reciprocate by electromagnetic force between the permanent magnet and the inner (or outer) stator. Also, since the permanent magnet is driven in a state where the permanent magnet is connected to the piston, the permanent magnet suctions and compresses the refrigerant while linearly reciprocating within the cylinder and then discharge the compressed refrigerant.

In relation to the linear compressor having the above-described structure, the present applicant has field a prior art document 1.

PRIOR ART DOCUMENT 1

1. Patent Publication Number: 10-2017-0124908 (Date of Publication: Nov. 13, 2017)

2. Tile of the Invention: LINEAR COMPRESSOR

The permanent magnet and the piston may reciprocate to compress the refrigerant according to the structure disclosed in the prior art document 1. In detail, the suction refrigerant passes through a piston and then is introduced into the compression chamber so as to be compressed by the piston. Also, the compressed high-temperature refrigerant is discharged to the outside of a shell via a discharge room defined in a discharge cover.

Here, the linear compressor disclosed in the prior art document 1 has the following limitations.

(1) The suction refrigerant is overheated to deteriorate compression efficiency.

A frame, a piston, and a cylinder may be disposed to contact each other so that the heat of the frame is easily transferred to the piston and the cylinder by conduction. Also, since the frame is disposed to be coupled to the discharge cover, heat may be transferred from the discharge cover. Here, since a compressed high-temperature refrigerant flows within the discharge cover, the discharge cover may have a very high temperature.

That is, the heat of the discharge cover is transferred to the frame, the piston, and the cylinder. Also, since the frame, the piston, and the cylinder are heated, the suction refrigerant flowing into the piston is heated. Thus, the suction refrigerant increases in volume to deteriorate the compression efficiency.

(2) Also, the discharge cover and the frame are not sufficiently heat-exchanged with the shell refrigerant accommodated in the shell. This is done because a flow rate of the shell refrigerant is slow, and thus, sufficient convection heat exchange does not occur.

Also, the discharge cover is entirely coupled to the frame, and thus, an area of the frame, which is exposed to the inside of the shell, is relatively small. Thus, the frame is not sufficiently heat-exchanged with the shell refrigerant.

SUMMARY

Embodiments provide a linear compressor including a passage guide through which a flow rate of a shell refrigerant increases so that a discharge cover and a frame are effectively heat-exchanged with the shell refrigerant.

Embodiments also provide a linear compressor in which an area of a discharge cover covering a frame is minimized to maximize an area of the frame, which is exposed to the shell refrigerant.

Embodiments also provide a linear compressor in which heat dissipation of a frame is minimized to minimize heat transfer to a piston and a cylinder and prevent a suction refrigerant from being overheated, thereby improving compression efficiency.

In one embodiment, a linear compressor includes a shell defining an internal space, a compressor body disposed in the internal space, and a passage guide disposed between the shell and the compressor body. The passage guide may include a first guide part extending along an inner surface of the shell in an axial direction and a second guide part extending from the first guide part to the compressor body in a radial direction.

The compressor body may include a frame in which a cylinder is accommodated and a discharge cover coupled to the frame. The first guide part may be disposed outside the discharge cover in the radial direction, and the second guide part may be disposed in front of the frame in the axial direction.

The discharge cover may include: a cover flange part coupled to a discharge frame surface of the frame and a chamber part extending forward from the cover flange part in the axial direction. The first guide part may be disposed outside the chamber part or the cover flange part in the radial direction, and the second guide part may be disposed in front of the discharge frame surface in the axial direction.

The second guide part may include a guide rear surface disposed in rear thereof in the axial direction, and the guide rear surface may be disposed in the same line as the cover flange part in the radial direction.

The details of one or more embodiments are set forth in the accompanying drawings and the description below. Other features will be apparent from the description and drawings, and from the claims.

DETAILED DESCRIPTION OF THE EMBODIMENTS

Figure 1:
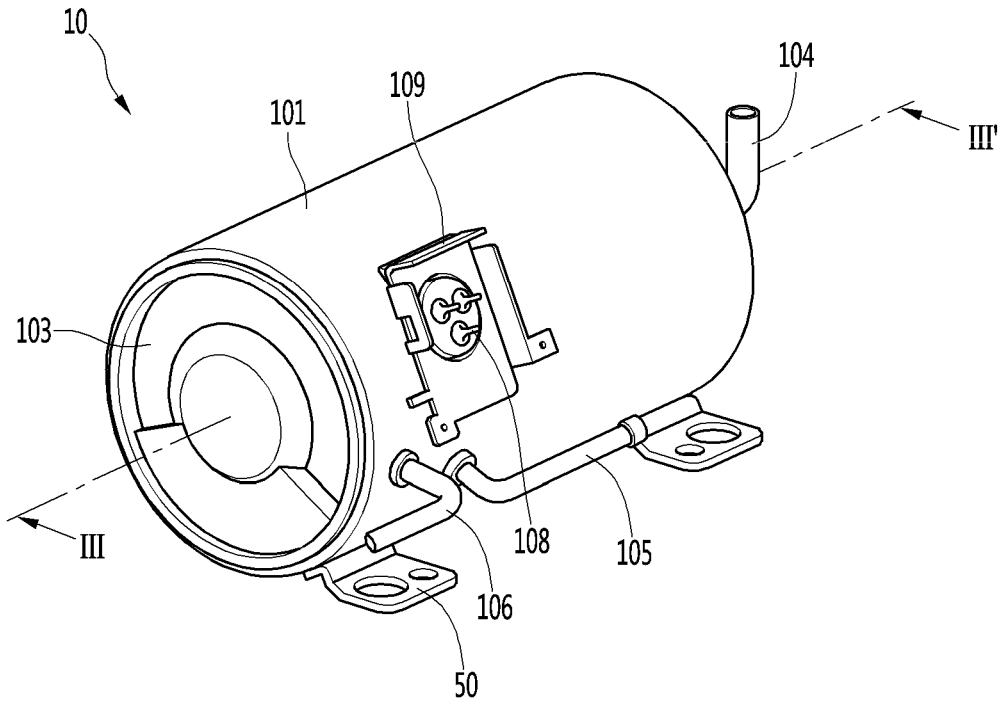
FIG. 1 is a view of a linear compressor according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. In the following description of the present disclosure, a detailed description of known functions and configurations incorporated herein will be omitted to avoid making the subject matter of the present disclosure unclear.

In the description of the elements of the present disclosure, the terms first, second, A, B, (a), and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a view of a linear compressor according to an embodiment.

Referring to FIG. 1, a linear compressor 10 according to an embodiment includes a shell 101 and shell covers 102 and 103 coupled to the shell 101. In a broad sense, each of the shell covers 102 and 103 may be understood as one component of the shell 101.

A leg 50 may be coupled to a lower portion of the shell 101. The leg 50 may be coupled to a base of a product in which the linear compressor 10 is installed. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction.

That is, since the linear compressor 10 has a low height, for example, when For example the linear compressor 10 is installed in the machine room base of the refrigerator, a machine room may be reduced in height.

Also, a longitudinal central axis of the shell 101 may correspond to a central axis of the compressor body, which will be described later. The central axis of the compressor body may correspond to a central axis of each of the cylinder and the piston, which constitute the compressor body.

A terminal 108 may be installed on an outer surface of the shell 101. The terminal 108 may be understood as a component for transmitting external power to a motor assembly (see reference numeral 140 of FIG. 3) of the linear compressor 10. Particularly, the terminal 108 may be connected to a lead line of a coil (see reference numeral 141*c* of FIG. 3).

A bracket 109 is installed outside the terminal block 108. The bracket 109 may include a plurality of brackets surrounding the terminal 108. The bracket 109 may protect the terminal block 108 against an external impact and the like.

Both sides of the shell 101 may be opened. The shell covers 102 and 103 may be coupled to both opened sides of the shell 101. In detail, the shell covers include a first shell cover (see reference numeral 102 of FIG. 3) coupled to one side, which is opened, of the shell 101. Also, the shell covers include a second shell cover 103 coupled to the other side, which is opened, of the shell 101. An inner space of the shell 101 may be sealed by the shell covers 102 and 103.

In FIG. 1, the first shell cover 102 may be disposed at a right portion of the linear compressor 10, and the second shell cover 103 may be disposed at a left portion of the linear compressor 10. That is to say, the first and second shell covers 102 and 103 may be disposed to face each other. Also, the first shell cover 102 may be disposed at a refrigerant suction-side, and the discharge shell cover 103 may be disposed at a refrigerant discharge-side.

The linear compressor 10 further includes a plurality of pipes 104, 105, and 106, which are provided in the shell 101 or the shell covers 102 and 103 to suction, discharge, or inject the refrigerant.

The plurality of pipes 104, 105, and 106 include a suction pipe 104 through which the refrigerant is suctioned into the linear compressor 10, a discharge pipe 105 through which the compressed refrigerant is discharged from the linear compressor 10, and a process pipe through which the refrigerant is supplemented to the linear compressor 10.

For example, the suction pipe 104 may be coupled to the first shell cover 102. The refrigerant may be suctioned into the linear compressor 10 through the suction pipe 104 in an axial direction.

The discharge pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be disposed at a position that is closer to the second shell cover 103 than the first shell cover 102.

The process pipe 106 may be coupled to an outer circumferential surface of the shell 101. A worker may inject the refrigerant into the linear compressor 10 through the process pipe 106.

The process pipe 106 may be coupled to the shell 101 at a height different from that of the discharge pipe 105 to avoid interference with the discharge pipe 105. The height is understood as a distance from the leg 50 in the vertical direction. Since the discharge pipe 105 and the process pipe 106 are coupled to the outer circumferential surface of the shell 101 at the heights different from each other, work convenience may be improved.

At least a portion of the second shell cover 103 may be disposed adjacent to the inner circumferential surface of the shell 101, which corresponds to a point to which the process pipe 106 is coupled. That is to say, at least a portion of the second shell cover 103 may act as flow resistance of the refrigerant injected through the process pipe 106.

Thus, in view of a passage for the refrigerant, the passage for the refrigerant introduced through the process pipe 106 decreases in size by the second shell cover 103 when entering into the inner space of the shell 101 and then increases in size again after passing through the inner space of the shell 101.

In this process, a pressure of the refrigerant may be reduced to allow the refrigerant to be vaporized. Also, an oil component contained in the refrigerant may be separated. Thus, the refrigerant from which the oil component is separated may be introduced into the piston (see reference numeral 130 of FIG. 3) to improve compression performance of the refrigerant. The oil component may be understood as working oil existing in a cooling system.

A device supporting the compressor body disposed inside the shell 101 may be provided inside the first and second shell covers 102 and 103. Here, the compressor body represents a component provided in the shell 101. For example, the compressor body may include a driving part that reciprocates forward and backward and a support part supporting the driving part.

Hereinafter, the compressor body will be described in detail.

Figure 2:
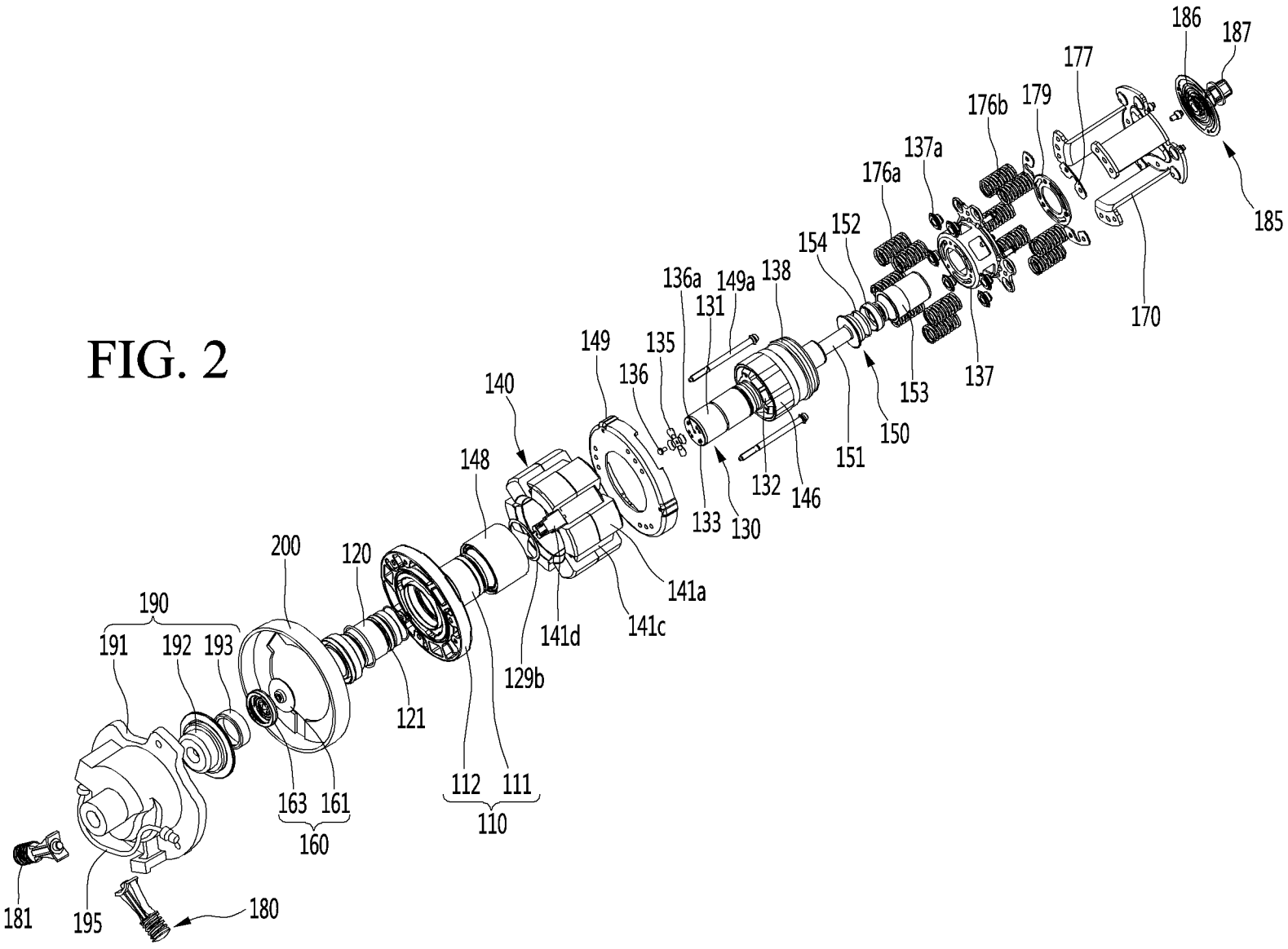
FIG. 2 is an exploded view illustrating an internal configuration of the linear compressor according to an embodiment.
Figure 3:
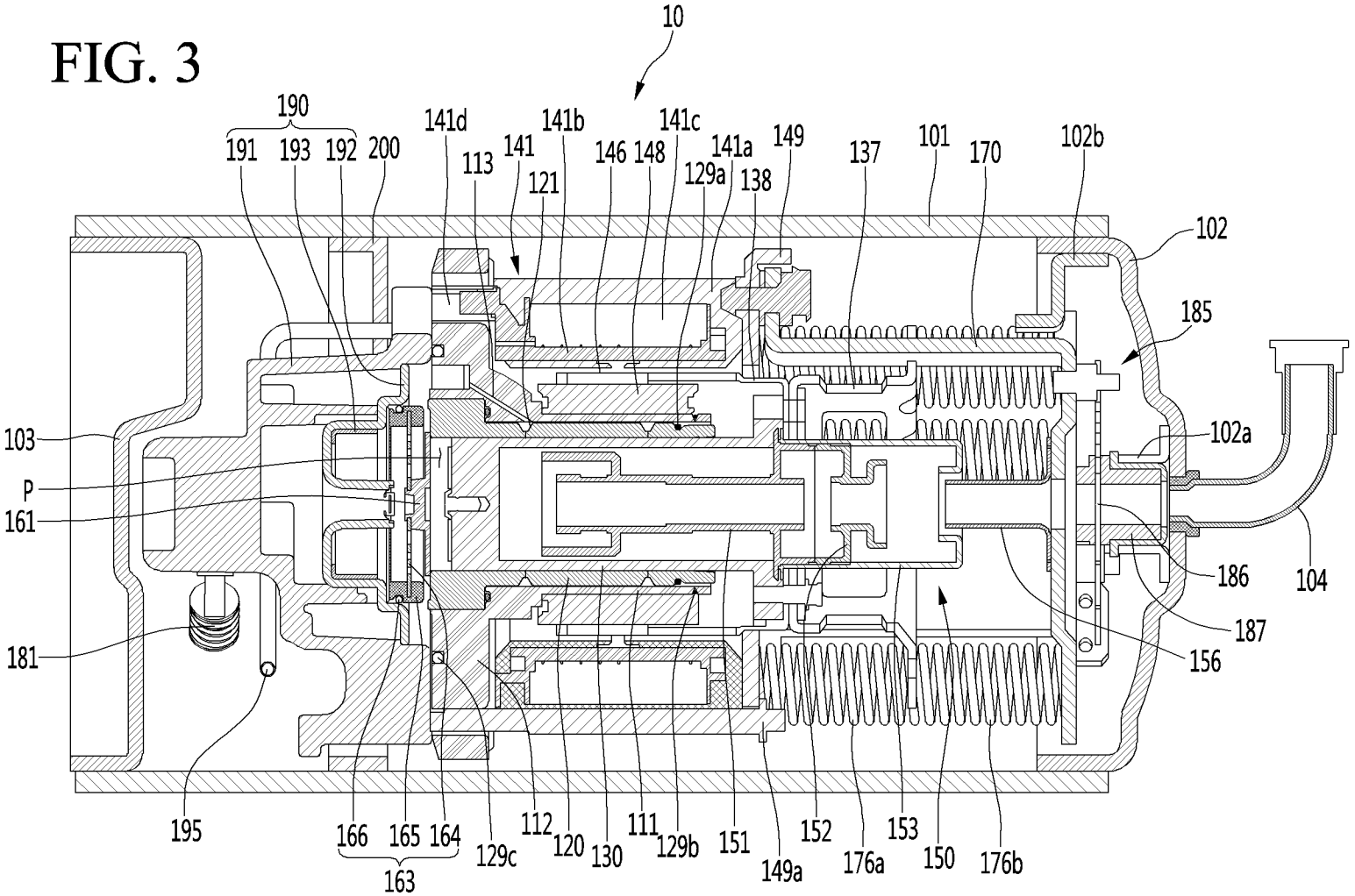
FIG. 3 is a cross-sectional view taken along line III-III' of FIG. 1.

FIG. 2 is an exploded view illustrating an internal configuration of the linear compressor according to an embodiment, and FIG. 3 is a cross-sectional view taken along line of FIG. 1.

Referring to FIGS. 2 and 3, the linear compressor 10 according to an embodiment includes a frame 110 provided inside the shell 101, cylinder 120 provided in the shell 101, a piston 130 that linearly reciprocates within the cylinder 120, and a motor assembly 140 that functions as a linear motor for applying driving force to the piston 130. When the motor assembly 140 is driven, the piston 130 may linearly reciprocate in the axial direction.

Hereinafter, the direction will be defined.

The "axial direction" may be understood as a direction in which the piston 130 reciprocates, i.e., the horizontal direction in FIG. 3. Also, in the axial direction", a direction from the suction pipe 104 toward a compression space P, i.e., a direction in which the refrigerant flows may be defined as a "forward direction", and a direction opposite to the front direction may be defined as a "backward direction". When the piston 130 moves forward, the compression space P may be compressed.

The "radial direction" may be understood as a direction that is perpendicular to the direction in which the piston 130 reciprocates, i.e., an axial direction, for example, in a vertical direction in FIG. 3. Also, a direction that is away from the central axis of the piston 130 may be defined as "the outside", and a direction that is close to the central axis may be defined as "the inside". The central axis of the piston 130 may correspond to the central axis of the shell 101 as described above.

The frame 110 is understood as a component for fixing the cylinder 120. The frame 110 includes a frame body 111 extending in the axial direction and a frame flange 112 extending outward from the frame body 111 in the radial direction. Here, the frame body 111 and the frame flange 112 may be integrated with each other.

The cylinder 120 is accommodated in the frame body 111. For example, the cylinder 120 may be press-fitted into the frame body 111. Also, the cylinder 120 may be made of aluminum or an aluminum alloy material, like the frame 110.

The frame flange 112 extends from a front end of the frame body 111 in the radial direction. The frame flange 112 may be understood as a structure coupled to the discharge unit 190 that will be described later. One side of the outer stator 141 that will be described later is supported by the frame flange 112.

Also, the frame 110 includes a gas passage 113 for guiding a predetermined refrigerant to the cylinder 120. The gas passage 113 has one end disposed on a front surface of the frame flange 11 and the other end connected to an outer circumferential surface of the cylinder 120.

The cylinder 120 is configured to accommodate at least a portion of the piston 130. Also, the cylinder 120 has a compression space P in which the refrigerant is compressed by the piston 130.

Also, a gas inflow part 121 recessed inward from an outer circumference of the cylinder 120 in the radial direction contacting the gas passage 113 is provided. The gas inflow part 121 may be provided along the outer circumference of the cylinder 120 and provided in plurality spaced apart from each other in the axial direction. Also, the gas inflow part 121 may extend up to the outer circumference of the cylinder 120, i.e., an outer circumference of the piston 130.

A portion of the refrigerant discharged from the compression space P through the gas passage 113 may flow into the gas inflow part 121. Then, the refrigerant may flow from the gas inflow part 121 to the cylinder 120 and the piston 130.

The refrigerant flowing as described above may provide lifting force to the piston 130 to perform a function of a gas bearing for the piston 130. According to the above-described effect, the bearing function may be performed by using at least a portion of the discharge refrigerant to prevent the piston 130 and the cylinder 120 from being worn.

The piston 130 includes a piston body 131 having an approximately cylindrical shape and a piston flange 132 extending from the piston body 131 in the radial direction. The piston body 131 may reciprocate inside the cylinder 120, and the piston flange 132 may reciprocate outside the cylinder 120.

A suction hole 133 through which the refrigerant is introduced into the compression space P is defined in a front surface of the piston body 131, and a suction valve 135 for selectively opening the suction hole 133 is disposed on a front side of the suction hole 133.

Also, a coupling hole 136*a* to which a predetermined coupling member 136 is coupled is defined in a front surface of the piston body 131. In detail, the coupling hole 136*a* may be defined in a center of the front surface of the piston body 131, and a plurality of suction holes 133 are defined to surround the coupling hole 136*a*. Also, the coupling member 136 passes through the suction valve 135 and is coupled to the coupling hole 136*a* to fix the suction valve 135 to the front surface of the piston body 131.

The motor assembly 140 includes an outer stator 141 fixed to the frame 110 and disposed to surround the cylinder 120, an inner stator 148 disposed to be spaced inward from the outer stator 141, and a permanent magnet 146 disposed in a space between the outer stator 141 and the inner stator 148.

The permanent magnet 146 may linearly reciprocate by a mutual electromagnetic force between the outer stator 141 and the inner stator 148. Also, the permanent magnet 146 may be provided as a single magnet having one polarity or be provided by coupling a plurality of magnets having three polarities to each other.

The permanent magnet 146 may be disposed on the magnet frame 138. The magnet frame 138 may have an approximately cylindrical shape and be disposed to be inserted into the space between the outer stator 141 and the inner stator 148.

In detail, in FIG. 3, the magnet frame 138 may be coupled to the piston flange 132 to extend outward in the radial direction and then be bent forward. The permanent magnet 146 may be installed on a front portion of the magnet frame 138. Thus, when the permanent magnet 146 reciprocates, the piston 130 may reciprocate together with the permanent magnet 146 in the axial direction.

The outer stator 141 includes coil winding bodies 141*b*, 141*c*, and 141*d* and a stator core 141*a*. The coil winding bodies 141*b*, 141*c*, and 141*d* include a bobbin 141*b* and a coil 141*c* wound in a circumferential direction of the bobbin 141*b*.

The coil winding bodies 141*b*, 141*c*, and 141*d* further include a terminal part 141*d* that guides a power line connected to the coil 141*c* so that the power line is led out or exposed to the outside of the outer stator 141. The terminal part 141*d* may be inserted into a terminal insertion hole 1104 provided in the frame 110.

The stator core 141*a* includes a plurality of core blocks in which a plurality of laminations are laminated in a circumferential direction. The plurality of core blocks may be disposed to surround at least a portion of the coil winding bodies 141*b* and 141*c*.

A stator cover 149 may be disposed on one side of the outer stator 141. Thus, the outer stator 141 may have one side supported by the frame 110 and the other side supported by the stator cover 149.

Also, the linear compressor 10 further includes a cover coupling member 149*a* for coupling the stator cover 149 to the frame 110. Also, since the cover coupling member 149*a* is coupled to the stator cover 149 and the frame flange 112, the outer stator 141 may be fixed. That is, the cover coupling member 149*a* extends from the stator cover 149 to the frame flange 112.

The inner stator 148 is fixed to an outer circumferential surface of the frame body 111. Also, in the inner stator 148, the plurality of laminations are laminated outside the frame 111 in a circumferential direction.

Also, the linear compressor 10 further include a suction muffler 150 coupled to the piston 130 to reduce a noise generated from the refrigerant suctioned through the suction pipe 104. The refrigerant suctioned through the suction pipe 104 flows into the piston 130 via the suction muffler 150. For example, while the refrigerant passes through the suction muffler 150, the flow noise of the refrigerant may be reduced.

The suction muffler 150 includes a plurality of mufflers 151, 152, and 153. The plurality of mufflers 151, 152, and 153 include a first muffler 151, a second muffler 152, and a third muffler 153, which are coupled to each other.

The first muffler 151 is disposed within the piston 130, and the second muffler 152 is coupled to a rear side of the first muffler 151. Also, the third muffler 153 accommodates the second muffler 152 therein and extends to a rear side of the first muffler 151.

In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

Also, the suction muffler 150 further includes a muffler filter 154. The muffler filter 154 may be disposed on an interface on which the first muffler 151 and the second muffler 152 are coupled to each other. For example, the muffler filter 154 may have a circular shape, and an outer circumferential portion of the muffler filter 154 may be supported between the first and second mufflers 151 and 152.

Also, the linear compressor 10 further includes a support 137 for supporting the piston 130. The support 137 may be coupled to a rear portion of the piston 130, and the muffler 150 may be disposed to pass through the inside of the support 137. Also, the piston flange 132, the magnet frame 138, and the support 137 may be coupled to each other by using a coupling member.

A balance weight 179 may be coupled to the support 137. A weight of the balance weight 179 may be determined based on a driving frequency range of the compressor body. Also, the support 137 may include a first spring support part 137*a* coupled to the first resonant spring 176*a* that will be described later.

Also, the linear compressor 10 further include a rear cover 170 coupled to the stator cover 149 to extend backward. The rear cover 170 includes three support legs, and the three support legs may be coupled to a rear surface of the stator cover 149.

Also, a spacer 177 may be disposed between the three support legs and the rear surface of the stator cover 149. A distance from the stator cover 149 to a rear end of the rear cover 170 may be determined by adjusting a thickness of the spacer 177. Also, the rear cover 170 may be spring-supported by the support 137.

Also, the linear compressor 10 further includes an inflow guide part 156 coupled to the rear cover 170 to guide an inflow of the refrigerant into the muffler 150. At least a portion of the inflow guide part 156 may be inserted into the suction muffler 150.

Also, the linear compressor 10 further includes a plurality of resonant springs 176*a* and 176*b* that are adjusted in natural frequency to allow the piston 130 to perform a resonant motion. The plurality of resonant springs 176*a* and 176*b* include a first resonant spring 176*a* supported between the support 137 and the stator cover 149 and a second resonant spring 176*b* supported between the support 137 and the rear cover 170.

The driving part that reciprocates within the linear compressor 10 may stably move by the action of the plurality of resonant springs 176*a* and 176*b* to reduce the vibration or noise due to the movement of the driving part.

Also, the linear compressor 10 includes a discharge unit 190 and a discharge valve assembly 160.

The discharge unit 190 defines a discharge space D through which the refrigerant discharged from the compression space P flows. The discharge unit 190 includes a discharge cover 191, a discharge plenum 192, and a fixing ring 193.

The discharge cover 191 is coupled to the frame 110. Particularly, the discharge cover 191 is coupled to a front surface of the frame flange 112. The discharge cover 191 will be described in detail.

The discharge plenum 192 is coupled to the inside of the discharge cover 191. Particularly, the discharge cover 191 and the discharge plenum 192 may be coupled to each other to define the plurality of discharge spaces D. The refrigerant discharged from the compression space P may sequentially pass through the plurality of discharge spaces D.

The fixing ring 193 is coupled to the inside of the discharge plenum 192. Here, the fixing ring 193 fixes the discharge plenum 192 to the discharge cover 193.

The discharge valve assembly 160 is seated inside the discharge unit 190 and discharges the refrigerant compressed in the compression space P to the discharge space D. Also, the discharge valve assembly 160 may include a discharge valve 161 and a spring assembly 163 providing elastic force in a direction in which the discharge valve 161 contacts the front end of the cylinder 120.

The spring assembly 163 may include a valve spring 164 having a plate spring shape, a spring support part 165 disposed on an edge of the valve spring 164 to support the valve spring 164, and a friction ring 166 inserted into an outer circumferential surface of the spring support part 165.

A central portion of a front surface of the discharge valve 161 is fixed and coupled to a center of the valve spring 164. Also, a rear surface of the discharge valve 161 contacts the front surface (a front end) of the cylinder 120 by elastic force of the valve spring 164.

When a pressure in the compression space P is equal to or greater than the discharge pressure, the valve spring 164 is elastically deformed toward the discharge plenum 192. Also, the discharge valve 161 is spaced apart from a front end of the cylinder 120 so that the refrigerant is discharged into the discharge space D (or the discharge chamber) defined in the discharge plenum 192 in the compression space P.

That is, when the discharge valve 161 is supported on the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

Thus, the compression space P may be understood as a space defined between the suction valve 135 and the discharge valve 161. Also, the suction valve 135 may be disposed on one side of the compression space P, and the discharge valve 161 may be disposed on the other side of the compression space P, i.e., an opposite side of the suction valve 135.

While the piston 130 linearly reciprocates within the cylinder 120, when the pressure of the compression space P is less than a suction pressure of the refrigerant, the suction valve 135 may be opened to suction the refrigerant into the compression space P.

On the other hand, when the pressure in the compression space P is greater than the suction pressure of the refrigerant, the suction valve 135 is closed, and the piston moves forward to compress the refrigerant within the compression space P.

When the pressure in the compression space P is greater than the pressure (the discharge pressure) in the discharge space D, the valve spring 164 is deformed forward to separate the discharge valve from the cylinder 120. Also, the refrigerant within, the compression space P is discharged into the discharge space D defined in the discharge plenum 191 through a space between the discharge valve 161 and the cylinder 120.

When the refrigerant is completely discharged, the valve spring 164 may provide restoring force to the discharge valve 161 so that the discharge valve 161 contact the front end of the cylinder 120 again.

Also, the linear compressor 10 may further include a cover pipe 195. The cover pipe 195 discharges the refrigerant flowing into the discharge unit 190 to the outside.

Here, the cover pipe 195 has one end coupled to the discharge cover 191 and the other end coupled to the discharge pipe 105. Also, at least a portion of the cover pipe 195 may be made of a flexible material and roundly extend along the inner circumferential surface of the shell 101.

Also, the linear compressor 10 includes the frame 110 and a plurality of sealing members for increasing coupling force between the peripheral components around the frame 110. Each of the plurality of sealing members may have a ring shape.

In detail, the plurality of sealing members may include a first sealing member 129*a* disposed on a portion at which the frame 110 and the cylinder 120 are coupled to each other, a second sealing member 129*b* disposed on a portion at which the frame 110 and the inner stator 148 are coupled to each other, and a third sealing member 129*c* disposed on a portion at which the discharge cover 191 is coupled.

Also, the linear compressor 10 includes support devices 180 and 185 for fixing the compressor body to the inside of the shell 101. The support device includes a first support device 185 disposed at the suction-side of the compressor body and a second support device 180 disposed at the discharge-side of the compressor body.

The first support device 185 includes a suction spring 186 provided in a circular plate spring shape and a suction spring support part 187 fitted into a center of the suction spring 186.

An outer edge of the suction spring 186 may be fixed to a rear surface of the rear cover 170 by a coupling member. The suction spring support part 187 is coupled to the cover support part 102*a* disposed at a center of the suction shell cover 102. Thus, the rear end of the compressor body may be elastically supported at the central portion of the first shell cover 102.

Also, a suction stopper 102*b* may be disposed on an inner edge of the first shell cover 102. The suction stopper 102*b* may be understood as a component for preventing the compressor body, particularly, the motor assembly 140 from being bumped by the shell 101 and thus damaged due to the shaking, the vibration, or the impact occurring during the transportation of the linear compressor 10.

Particularly, the suction stopper 102*b* may be disposed adjacent to the rear cover 170. Thus, when the linear compressor 10 is shaken, the rear cover 170 may interfere with the suction stopper 102*b* to prevent the impact from being directly transmitted to the motor assembly 140.

The second support device 180 includes a pair of discharge support parts 181 extending in the radial direction. The discharge support part 181 has one end fixed to the discharge cover 191 and the other end contacting an inner circumferential surface of the shell 101. Thus, the discharge support part 181 may support the compressor body in a radial direction.

For example, the pair of discharge support part 181 are disposed at an angle of about 90 degrees to about 120 degrees with respect to each other in the circumferential direction with respect to the lower end that is closest to the bottom surface. That is, the lower portion of the compressor body may be supported at two points.

Also, the second support device 180 may include a discharge sparing (not shown) installed in the axial direction. For example, the discharge spring (not shown) may be disposed between an upper end of the discharge cover 191 and the second shell cover 103.

Also, a passage guide 200 is provided in the linear compressor 10 according to an embodiment. The passage guide 200 may correspond to a constituent that is disposed outside the discharge cover 191 in the radial direction to provide a passage through which the refrigerant flows.

Hereinafter, the discharge cover 191, the frame 110, and the passage guide 200 will be described in detail.

Figure 4:
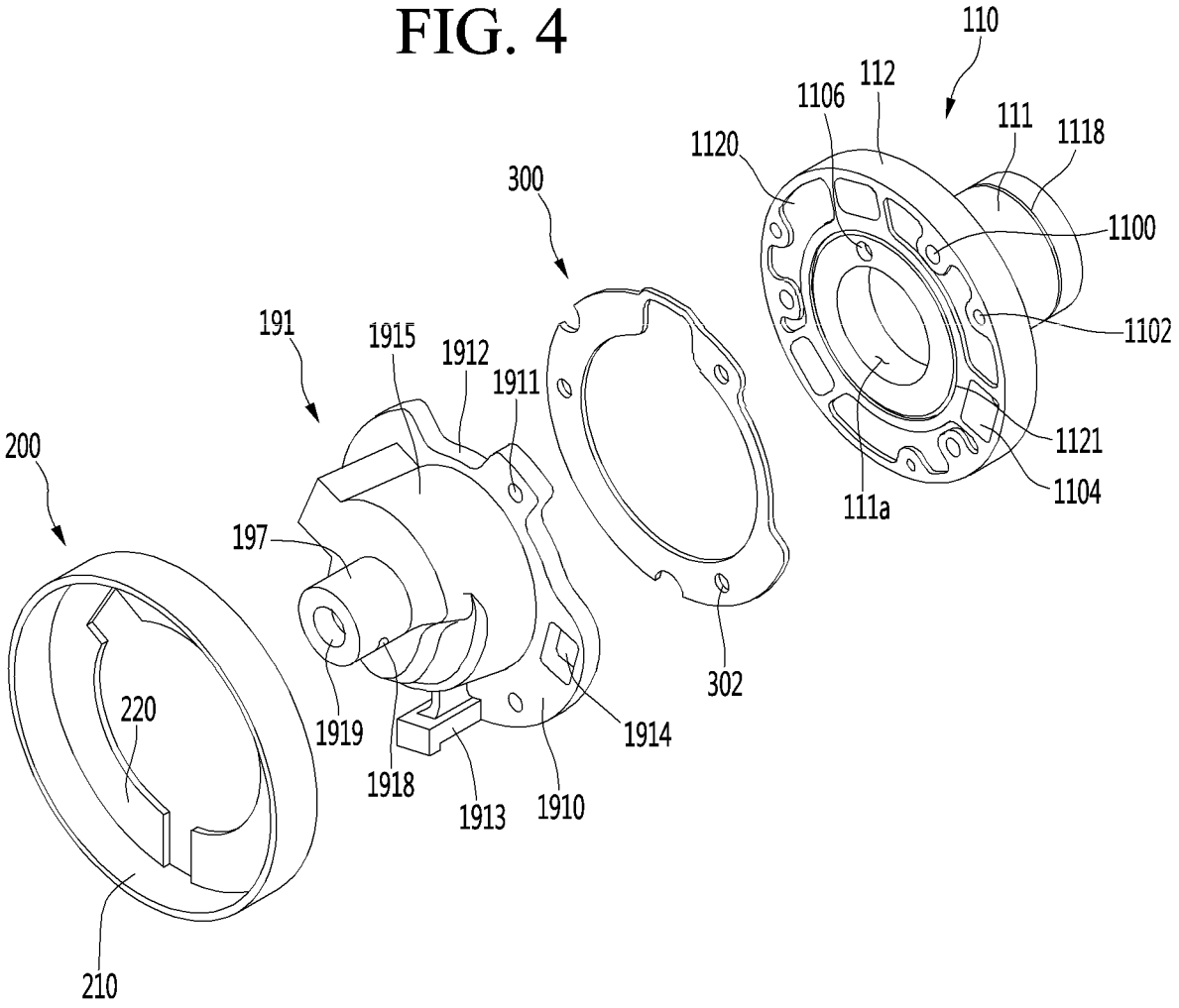
FIG. 4 is an exploded perspective view illustrating a discharge cover, a frame, and a passage guide of a linear compressor according to a first embodiment.
Figure 5:
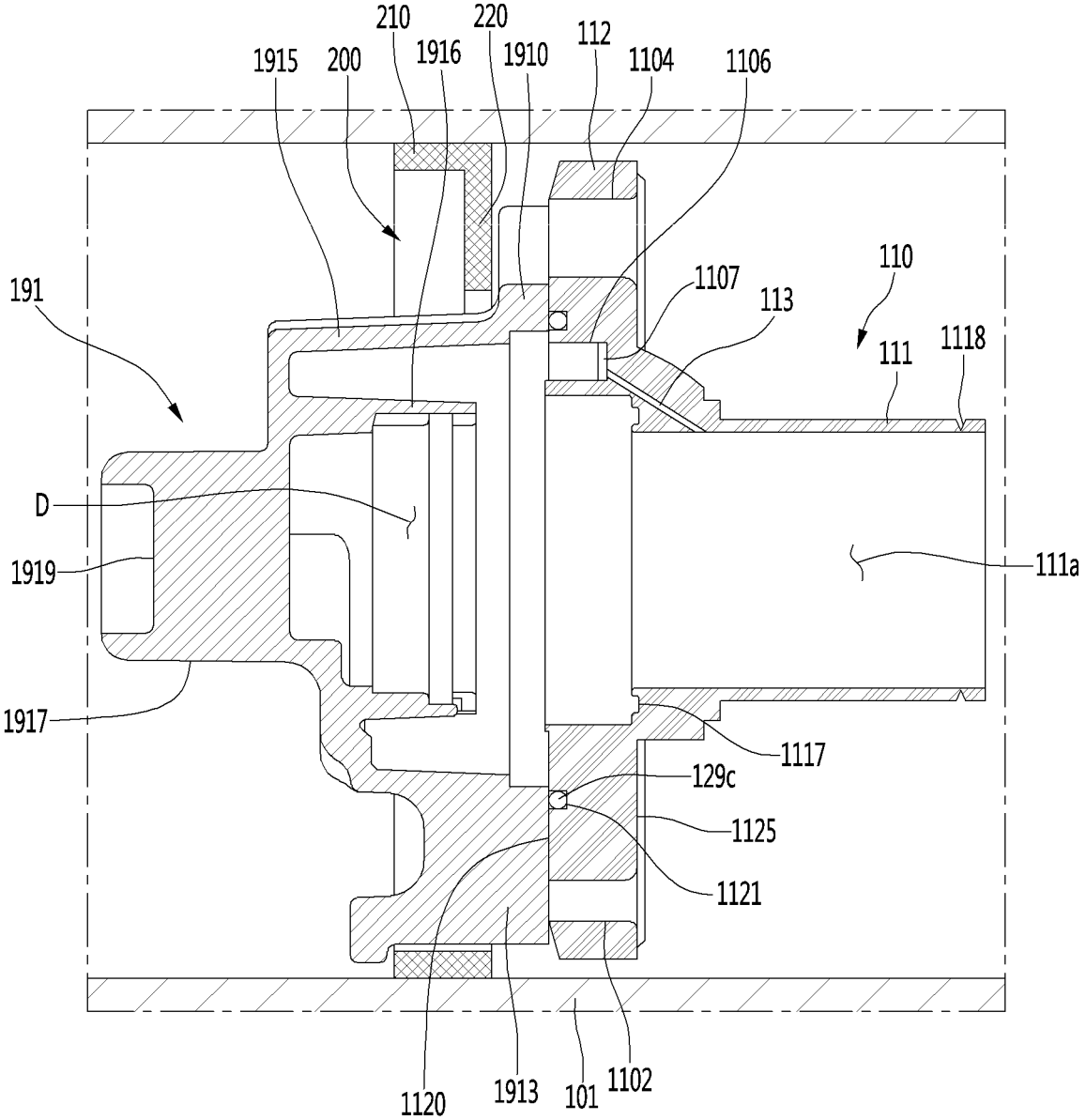
FIG. 5 is a view illustrating a coupled cross-section of the discharge cover, the frame, and the passage guide of the linear compressor according to the first embodiment.

FIGS. 4 and 5 are views illustrating a discharge cover, a frame, and a passage guide of a linear compressor according to a first embodiment. In FIGS. 4 and 5, for convenience of description, other constituents will be omitted, and the discharge cover 191, the frame 110, and the passage guide 200 will be illustrated.

Particularly, FIG. 4 illustrates an exploded perspective view of the discharge cover 191, the frame 110, and the passage guide 200. Also, in FIG. 4, a gasket 300 disposed between the discharge cover 191 and the frame 110 is illustrated together.

FIG. 5 illustrates a coupled cross-section of the discharge cover 191, the frame 110, and the passage guide 200. Also, in FIG. 5, for convenience of description, a portion of the shell 101 is illustrated together.

As illustrated in FIGS. 4 and 5, the discharge cover 191 is coupled to an upper portion of the frame 110. Here, the discharge cover 191 and the frame 119 may be coupled to each other by a predetermined coupling member (not shown).

As described above, the frame 110 includes a frame body 111 and a frame flange 112. The frame body 111 may have a cylindrical shape of which upper and lower ends in the axial direction are opened.

Sealing member insertion parts 1117 and 1118 are provided in the frame body 111. The sealing member insertion parts 1117 and 1118 include a first sealing member insertion part 1117 which is provided inside the frame body 111 and into which a first sealing member 129*a* is inserted. Also, the sealing member insertion parts include a second sealing member insertion part 1118 which is provided on an outer circumferential surface of the frame body 111 and into which the second sealing member 129*b* is inserted.

Also, a cylinder accommodation part 111*a* into which a cylinder 120 is accommodated is provided inside the frame body 111 in the radial direction. Thus, the cylinder 120 is accommodated in the frame body 111 in the radial direction, and at least a part of the piston 130 is accommodated in the cylinder 120 in the radial direction.

Also, an inner stator 148 is coupled to the outside of the frame body 111 in the radial direction. The outer stator 141 is disposed outward the inner stator 148 in the radial direction, and a permanent magnet 146 is disposed between the inner stator 148 and an outer stator 141.

The frame flange 112 have a circular plate shape having a predetermined thickness in the axial direction. Also, the cylinder accommodation part 111*a* is provided at a central portion of the frame flange 112 in the radial direction. That is, the frame flange 112 has a ring shape having a predetermined thickness in the axial direction.

Particularly, the frame flange 112 extends outward from a front end of the frame body 111 in the radial direction. Here, the inner stator 148, the permanent magnet 146, and the outer stator 141, which are disposed outside the frame body 111 in the radial direction, may be disposed in rear of the frame flange 112 in the axial direction. Particularly, the front end of the outer stator 141 in the axial direction is fixed by the frame flange 112.

Also, a plurality of openings passing in the axial direction are defined in the frame flange 112. Particularly, the plurality of openings may be defined in an outer portion of the frame flange 112 in the radial direction. The plurality of openings include a discharge coupling hole 1100, a stator coupling hole 1102, and a terminal insertion hole 1104.

A predetermined coupling member (not shown) for coupling the discharge cover 191 to the frame 110 is inserted into the discharge coupling hole 1100. In detail, the coupling member (not shown) may be inserted to a front side of the frame flange 111 by passing through the discharge cover 191.

The cover coupling member 149*a* that is described above is inserted into the stator coupling hole 1102. The cover coupling member 149*a* may the stator cover 149 to the frame 110 to fix the outer stator 114 disposed between the stator cover 149 and the frame 110 in the axial direction.

The above-described terminal part 141*d* of the outer stator 141 may be inserted into the terminal insertion part 1104. That is, the terminal part 141*d* may be withdrawn or exposed to the outside through the terminal insertion hole 1104 by passing from the rear side to the front side of the frame flange 111. Also, the exposed terminal part 141*d* may be connected to the terminal 108 to receive external power.

Here, each of the discharge coupling hole 1100, the stator coupling hole 1102, and the terminal insertion hole 1104 may be provided in plurality, which are sequentially disposed spaced apart from each other in the circumferential direction. For example, each of the discharge coupling hole 1100, the stator coupling hole 1102, and the terminal insertion hole 1104 may be provided in three. For example, each of the discharge coupling hole 1100, the stator coupling hole 1102, and the terminal insertion hole 1104 may be disposed at an angle of about 120 degrees in the circumferential direction.

Also, the terminal insertion holes 1104, the discharge coupling holes 1100, and the stator coupling holes 1102 are sequentially disposed to be spaced apart from each other in the circumferential direction. Also, the openings adjacent to each other may be disposed to be spaced an angle of about 30 degrees from each other in the circumferential direction.

For example, the respective terminal insertion holes 1104 and the respective discharge coupling holes 1100 are disposed spaced an angle of about 30 degrees from each other in the circumferential direction. Also, the respective discharge coupling holes 1100 and the respective stator coupling holes 1102 are disposed to be spaced an angle of about 30 degrees from each other in the circumferential direction. For example, the respective terminal insertion holes 1104 and the respective stator coupling holes 1102 are disposed spaced an angle of about 60 degrees from each other in the circumferential direction.

Also, the terminal insertion holes 1104, the discharge coupling holes 1100, and the stator coupling holes 1102 are arranged based on a center of the circumferential direction.

Also, a center in the circumferential direction corresponds to a center in the axial direction.

Here, a front surface of the frame flange 112 is referred to as a discharge frame surface 1120, and a rear surface thereof is referred to as a motor frame surface 1125. That is, the discharge frame surface 1120 and the motor frame surface 1125 correspond to surfaces opposite to each other in the axial direction. In detail, the discharge frame surface 1120 corresponds to a surface contacting the discharge cover 191. Also, the motor frame surface 1125 corresponds to a surface that is adjacent to the motor assembly 140.

A third sealing member insertion part 1121 into which a third sealing member 129*c* is inserted is provided in the discharge frame surface 1120. In detail, the third sealing member insertion part 1121 has a ring shape and is recessed backward from the discharge frame surface 1120 in the axial direction. Also, the third sealing member insertion part 1121 is defined inside the terminal insertion hole 1104, the discharge coupling hole 1100, and the stator coupling hole 1102 in the radial direction.

Here, the third sealing member 120*c* may be understood as a discharge sealing member that prevents the discharge refrigerant from leaking between the discharge cover 191 and the frame 110. Also, the third sealing member insertion part 1121 may be understood as a discharge sealing member insertion part.

Also, a gas hole 1106 communicating with the gas passage 113 is defined in the discharge frame surface 1120. The gas hole 1106 is recessed backward from the discharge frame surface 1120 in the axial direction. Also, a gas filter 1107 for filtering foreign substances contained in the flowing gas may be mounted on the gas hole 1106.

Here, the gas hole 1106 is defined inside the third sealing member insertion part 1121 in the radial direction. That is, the third sealing member insertion part 1121 is defined inside the terminal insertion hole 1104, the discharge coupling hole 1100, and the stator coupling hole 1102 in the radial direction, and the gas hole 1106 is defined inside the third sealing member insertion part 1121 in the radial direction. Also, the gas hole 1106 may be defined in the same line as one of the terminal insertion holes 1104 in the radial direction.

Also, referring to FIG. 4, a predetermined recess structure may be provided in the discharge frame surface 1120. This is done for preventing heat of the discharge refrigerant from being transferred, and the recess structure is not limited in recessed depth and shape. For convenience of description, the above-described recessed structure has not been illustrated in FIG. 5.

The discharge cover 191 may be provided in a bowl shape as a whole. That is, the discharge cover may have a shape which has one opened surface and an internal space. Here, a rear side of the discharge cover 191 in the axial direction may be opened.

The discharge cover 191 includes a cover flange part 1910 coupled to the frame 110, a chamber part 1915 extending forward from the cover flange part 1910 in the axial direction, and a support device fixing part 1917 extending forward from the chamber part 1915 in the axial direction.

The cover flange part 1910 has a predetermined thickness in the axial direction and extends in the radial direction. Here, the cover flange part 1910 may be provided in a circular plate shape as a whole.

Particularly, the cover flange part 1910 may have a diameter corresponding to the discharge frame surface 1120. In detail, the diameter of the cover flange part 1910 is slightly less than that of the discharge frame surface 1120. For example, the diameter of the cover flange part 1910 may be about 0.9 times to about 0.95 times of the diameter of the discharge frame surface 1120.

An opening communicating with an opened rear side in the axial direction is defined in a central portion of the cover flange part 1910. The discharge plenum 192 may be mounted inside the discharge cover 191 the opening. Also, the opening may be understood as an opening in which the discharge valve assembly 160 is installed.

Also, the cover flange part 1910 includes a flange coupling hole 1911 through which a coupling member (not shown) to be coupled to the frame 110 passes. The flange coupling holes 1911 passes in the axial direction and is provided in plurality.

The flange coupling hole 1911 may have a size, a number, and a position corresponding to those of a discharge coupling hole 1100. The flange coupling holes 1911 may be provided in three positions spaced an angle of about 120 degrees from each other in the circumferential direction.

Also, a flange recess part 1912 that is recessed inward in the radial direction may be defined in the cover flange part 1910. The flange recess part 1912 may correspond to a structure that avoids an interference with the terminal part 141*d* and the terminal 108, which are described above.

As described above, the flange recess part 1912 may be differently formed according to the configuration disposed inside the shell 101. That is, the shape of the flange recess part 1912 may have various shapes without being limited to the shape of FIG. 4.

Also, a flange protrusion 1913 protruding forward in the axial direction is disposed on the cover flange part 1910. The flange protrusion 1913 corresponds to a portion contacting the shell 101 when the discharge cover 191 vibrates by a predetermined impact. That is, the flange protrusion 1913 may be understood as kind of stopper that prevents the compressor body including the discharge cover 191 from being damaged by collision with the shell 101.

The flange protrusion 1913 may protrude up to a front surface of the chamber part 1915 in the axial direction. Also, the flange protrusion 1913 is disposed to be spaced apart from the chamber part 1915 in the radial direction. Particularly, the flange protrusion 1913 is disposed outside the chamber part 1915 corresponding to a lower side of the linear compressor 10 in the radial direction.

Also, the flange protrusion 1913 corresponds to a portion that protrudes most outward from the discharge cover 191 in the radial direction. Thus, when the discharge cover 191 vibrates, the flange protrusion 1913 may contact the shell 101 first.

For example, the flange protrusion 1913 may have an elastic structure or be made of an elastic material. Also, the flange protrusion 1913 may be replaced with a passage guide or the like that will be described below and then omitted.

Also, at least one flange through-hole 1914 that is penetrated in the axial direction may be defined in the cover flange part 1910. The flange through-hole 1914 may be provided in various shapes and numbers. For example, the flange through-hole 1914 may have a shape corresponding to that of the terminal insertion hole 1104.

In detail, the terminal insertion hole 1104 may be provided in plurality in a circumferential direction of the frame flange 112. However, the terminal part 141*d* is inserted into one of the plurality of terminal insertion holes 1104. Thus, the terminal insertion hole 1104 into which the terminal part 141*d* is not inserted may be provided in an opened state. Here, the flange through-hole 1914 may be provided in shape and number corresponding to those of the terminal insertion hole 1104 that is provided in the opened state as described above.

Thus, when the discharge cover 191 and the frame 110 are coupled to each other, the flange through-hole 1914 and the terminal insertion hole 1104 may provide a passage that extends in the axial direction. Here, the refrigerant accommodated in the shell 101 by the driving of the linear compressor 10 may flow along the passage.

Noise due to the driving may be reduced by the above-described flow of the refrigerant. That is, the flange through-hole 1914 may be understood as a constituent that is provided in the discharge cover 191 to reduce the noise.

Each of the chamber part 1915 and the support device fixing part 1917 may have a cylindrical outer appearance. In detail, each of the chamber part 1915 and the support device fixing part 1917 has a predetermined outer diameter in the radial direction and extends in the axial direction. The outer diameter of the support device fixing part 1917 is less than the outer diameter of the chamber part 1915.

Also, the outer diameter of the chamber part 1915 is less than the outer diameter of the cover flange part 1910. That is, the discharge cover 191 may be stepped so that the outer diameter gradually decreases in the axial direction.

Also, the chamber part 1915 and the support device fixing part 1917 are provided in a shape of which a rear side in the axial direction is opened. Thus, each of the chamber part 1915 and the support device fixing portion 1917 may have an outer appearance defined by a cylindrical side surface and a cylindrical front surface.

The chamber part 1915 may extend forward from the cover flange part 1910 in the axial direction. A plurality of discharge spaces D through which the refrigerant sequentially flows may be defined in the chamber part 1915. Particularly, the chamber part 1915 includes a partition sleeve 1916 that partitions the internal space of the chamber part 1915 into the plurality of plurality discharge spaces D.

The partition sleeve 1916 may have a cylindrical shape inside the chamber part 1915. In detail, the partition sleeve 1916 may be disposed so that a predetermined space is defined between the partition sleeve 1916 and the outer surface of the chamber part 1915. Thus, the internal space of the chamber part 1915 may be partitioned by the partition sleeve 1916.

Also, the discharge plenum 192 may be mounted inside the partition sleeve 1916. Also, a plurality of grooves that are defined so that the refrigerant flows may be defined in the partition sleeve 1916. As described above, the refrigerant may sequentially flow through the plurality of discharge spaces D along the grooves.

Also, the chamber part 1915 may further include a pipe coupling part (not shown) to which the cover pipe 195 is coupled. Particularly, the cover pipe 195 may be coupled to the chamber part 1915 to communicate with one of the plurality of discharge spaces D. The cover pipe 195 may communicate with the discharge space D through which the refrigerant finally passes.

At least a portion of a top surface of the chamber part 1915 may be recessed to avoid interference with the cover pipe 195. When the cover pipe 195 is coupled to the chamber part 1915, the cover pipe 195 may be prevented from contacting the front surface of the chamber part 1915.

Fixed coupling parts 1918 and 1919 to which the above-described second support device 180 is coupled are disposed on the support device fixing part 1917. The fixed coupling part includes a first fixed coupling part 1918 to which the discharge support part 181 is coupled and a second fixed coupling part 1919 to which a discharge spring (not shown) is installed.

The first fixed coupling part 1918 may be recessed inward or penetrated from the outer surface of the support device fixing part 1917 in the radial direction. The first fixed coupling part 1918 is provided in a pair. The pair of first fixed coupling parts 1918 are spaced apart from each other in the circumferential direction to correspond to the pair of discharge support parts 181.

The second fixing part 1919 may be recessed backward from the front surface of the support device fixing part 1917 in the axial direction. Thus, at least a portion of the discharge spring (not shown) may be inserted into the second fixed coupling part 1919.

Here, the discharge cover 191 according to an embodiment may be integrally manufactured by aluminum die casting. Thus, unlike the discharge cover according to the related art, in the case of the discharge cover 191 according to an embodiment, a welding process may be omitted. Thus, the process of manufacturing the discharge cover 191 may be simplified, resulting in minimizing product defects, and the product cost may be reduced. Also, since there is no dimensional tolerance due to the welding, the refrigerant may be prevented from leaking.

The cover flange part 1910, the chamber part 1915, and the support device fixing part 1917, which are described above, are integrated with each other and may be understood as being divided for convenience of explanation.

Also, the linear compressor 10 includes a gasket 300 disposed between the frame 110 and the discharge cover 191. The gasket 300 is understood as a constituent through which the frame 110 and the discharge cover 191 are more tightly coupled to each other.

The gasket 300 may be disposed on at least a portion at which the discharge frame surface 1120 and the cover flange part 1910 overlap each other. Particularly, the gasket 300 may be disposed on a portion at which the frame 110 and the discharge cover 191 overlap each other outside the third sealing member **129*c*** in the radial direction.

Thus, the gasket 300 may have provided in a ring shape. In detail, an inner diameter of the gasket 300 corresponds to a diameter of the third sealing member **129*c* or the third sealing member insertion part 1121. Also, an outer diameter of the gasket 300 may correspond to a diameter of the cover flange part 1910**.

Also, the gasket 300 may have a shape corresponding to that of the cover flange part 1910. For example, a portion corresponding to the flange recess part 1912 and the flange through-hole 1914 is cut to be provided in the gasket 300.

Also, a gasket through-hole 302 corresponding to the flange coupling hole 1911 and the discharge coupling hole 1100 is defined in the gasket 300. The gasket through-hole 302 is provided in number and at position corresponding to the flange coupling hole 1911 and the discharge coupling hole 1100. That is, the gasket through-hole 302 may be provided in three that are spaced apart from each other at an angle of about 120 degrees in the circumferential direction.

The discharge cover 191, the gasket 300, and the frame 110 are laminated so that the flange coupling hole 1911 and the gasket through-hole 302, and the discharge coupling hole 1100 are sequentially disposed downward in the axial direction. Also, since a coupling member passes through the flange coupling hole 1911, the gasket through-hole 302, and the discharge coupling hole 1100, the discharge cover 191, the gasket 300, and the frame 110 may be coupled to each other.

Here, the compressed refrigerant flows through the discharge space D defined in the discharge cover 191, i.e., the chamber part 1915. That is, the refrigerant having a high temperature may flow through the chamber part 1915. As described above, the discharge cover 191 may increase in temperature as a whole.

Also, heat of the discharge cover 191 may be conducted to the frame 110 through the cover flange part 1910 and the discharge frame surface 1120. Thus, when the frame 110 increases in temperature, the cylinder 120 and the piston 130, which are disposed inside the frame 110, may increase in temperature. As a result, the suction refrigerant introduced into the piston 130 may increase in temperature to deteriorate the compression efficiency.

As described above, to prevent the compression efficiency from being deteriorated, the linear compressor 10 according to an embodiment include a passage guide 200. The passage guide 200 is disposed between the shell 101 and the compressor body.

The passage guide 200 includes a first guide part 210 extending in the axial direction and a second guide part 220 extending inward from the first guide part 210 in the radial direction. That is to say, the first guide part 210 may extend along the inner surface of the shell 101, and the second guide part 220 may extend from the first guide part 210 toward the compressor body.

Thus, the first guide part 210 may be disposed outside the discharge cover 191 in the radial direction, and the second guide part 220 may be disposed in front of the frame 110 in the axial direction. In detail, the first guide part 210 may be disposed outside the chamber part 1915 or the cover flange part 1910 in the radial direction, and the second guide part 220 may be disposed in front of the discharge frame surface 1125 in the axial direction.

As illustrated in FIG. 5, the passage guide 200 is disposed above the cover flange part 1910 and the frame flange 112 in the axial direction. Particularly, the passage guide 200 functions to provide the passage for the refrigerant flowing along the surfaces of the cover flange part 1910 and the frame flange 112.

In detail, since the piston 130 reciprocates, the refrigerant accommodated in the shell 101 (hereinafter, referred to as a shell refrigerant) may flow. Here, the shell refrigerant may flow forward and backward from the cover flange part 1910 and the frame flange 112 through the passage defined by the passage guide 200.

Here, the passage defined by the passage guide 200 may have a relatively narrow width. Thus, a flow rate of the shell refrigerant may increase in the passage so that the same amount of refrigerant flows.

As described above, convection heat transfer between the shell refrigerant and each of the cover flange part 1910 and the frame flange 112 may occur. Particularly, since the shell refrigerant has a temperature similar to that of the suction refrigerant, heat is transferred from the cover flange part 1910 and the frame flange 112 to the shell refrigerant.

Here, since a convective heat transfer coefficient is proportional to the flow rate, a convective heat transfer amount increases as the flow rate increases. That is, an amount of heat convected from the cover flange part 1910 and the frame flange 112 to the shell refrigerant may increase so that the heat of the cover flange 1910 and the frame flange 112 are effectively dissipated.

Also, as the heat is effectively dissipated in the frame flange 112, the heat transferred to the cylinder 120 and the piston 110 disposed inside the frame 110 is reduced. Thus, a temperature of the suction refrigerant is prevented from increasing, and the compression efficiency is improved.

Figure 6:
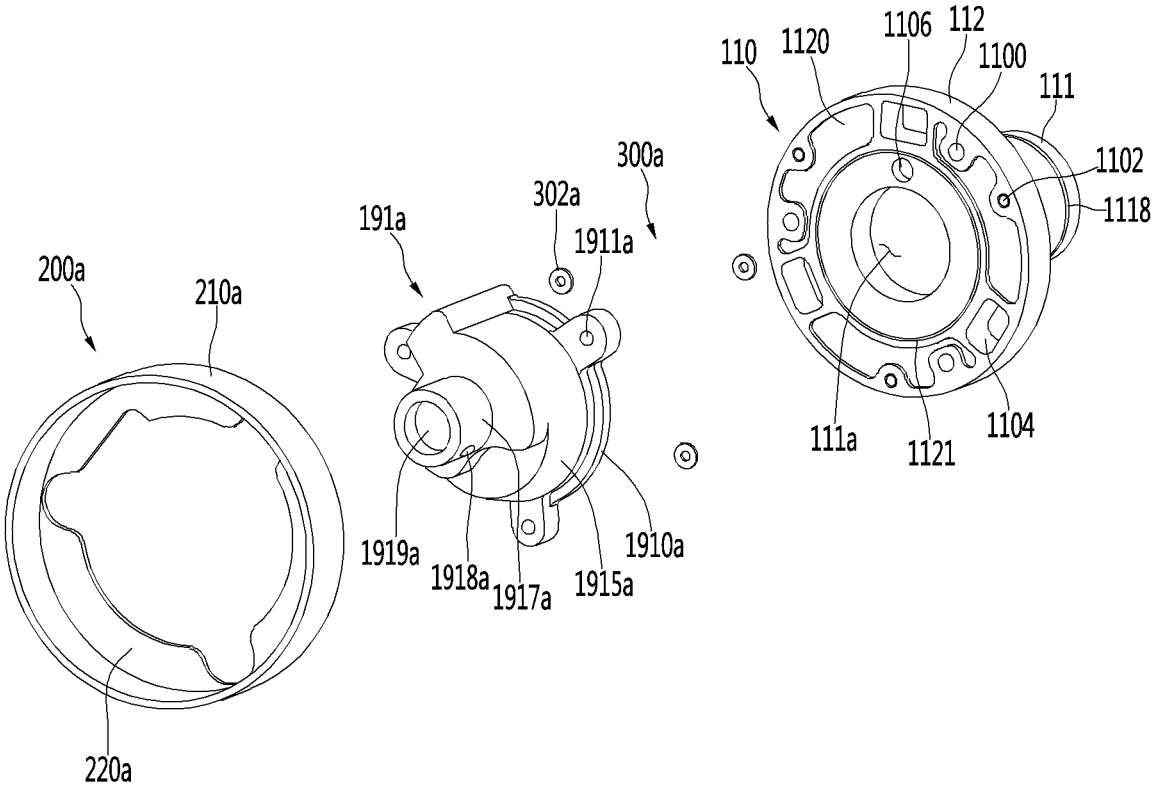
FIG. 6 is an exploded view illustrating a discharge cover, a frame, and a passage guide of a linear compressor according to a second embodiment.
Figure 7:
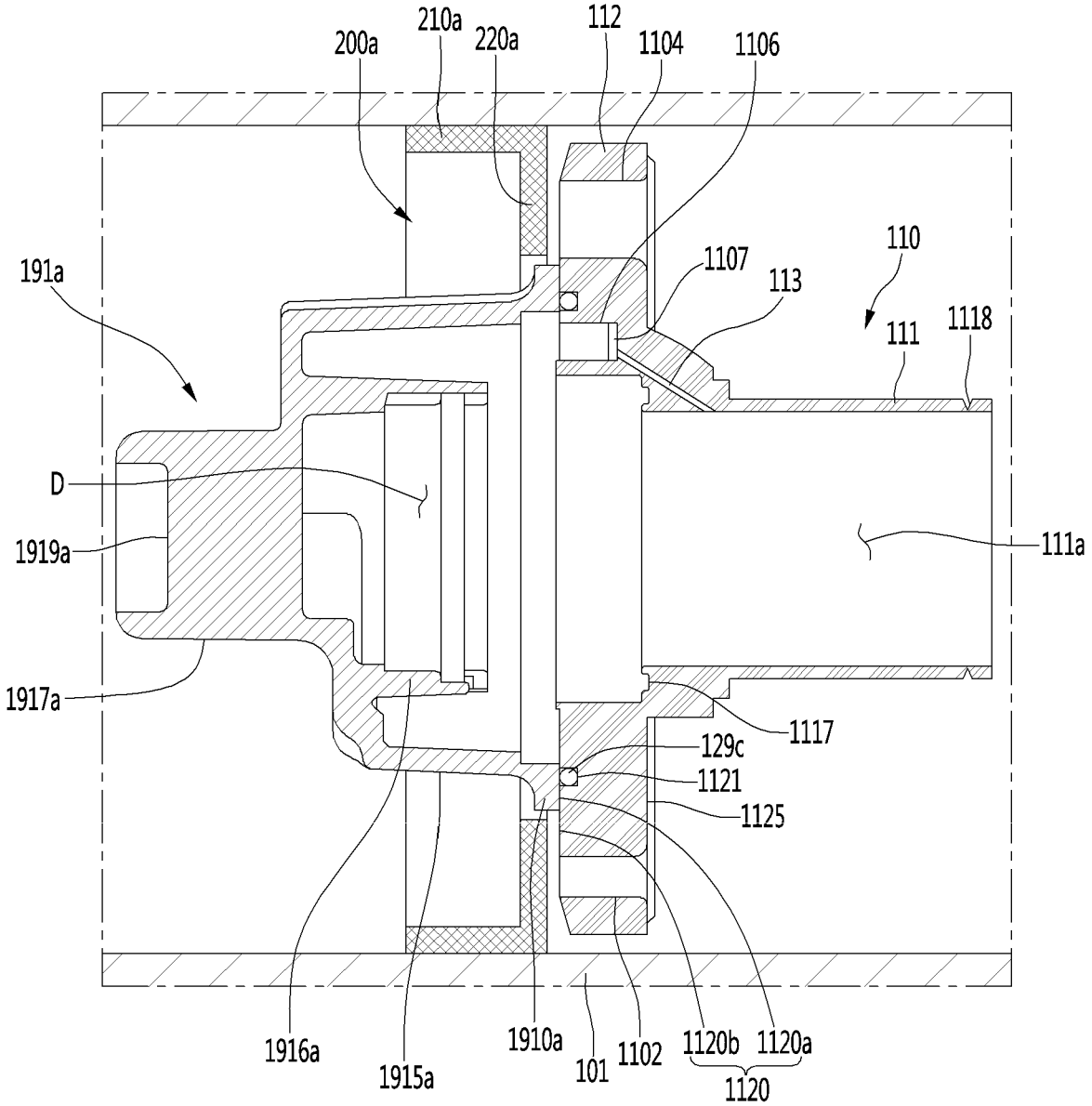
FIG. 7 is a view illustrating a coupled cross-section of the discharge cover, the frame, and the passage guide of the linear compressor according to the second embodiment.

FIGS. 6 and 7 are views illustrating a discharge cover, a frame, and a passage guide of a linear compressor according to a second embodiment. FIGS. 6 and 7 may correspond to FIGS. 4 and 5, and thus, description with respect to the same portion will be omitted and derived from the above-described description.

Particularly, the frame 110 described with reference to FIGS. 4 and 5 may be completely the same as the frame 110 described with reference to FIGS. 6 and 7, and thus, the same reference numeral may be used. Also, the discharge cover, the gasket, and the passage guide will be described with respect to the difference by adding 'a' to the reference numerals used in FIGS. 4 and 5.

As illustrated in FIGS. 6 and 7, the linear compressor according to the second embodiment includes a discharge cover 191*a*, a frame 110, a gasket 300*a*, and a passage guide 200*a*.

The discharge cover 191*a* includes a cover flange part 1910*a* coupled to the frame 110, a chamber part 1915*a* extending forward from the cover flange part 1910*a* in an axial direction, and a support device fixing part 1917*a* extending forward from the chamber part 1915*a* in the axial direction.

The cover flange part 1910*a* has a predetermined thickness in the axial direction and extends in a radial direction. Here, the cover flange part 1910*a* may be provided in a circular plate shape as a whole.

Also, the cover flange part 1910*a* may have a diameter corresponding to a third sealing member installation part 1121. In detail, the diameter of the cover flange part 1910*a* is slightly greater than the diameter of the third sealing member installation part 1121. As described above, the diameter of the cover flange 1910*a* is less than that of the cover flange part 1910 according to the first embodiment.

Also, the cover flange part 1910*a* is relatively small in comparison with a diameter of the discharge frame surface 1120. For example, the diameter of the cover flange part 1910*a* may be about 0.6 times to about 0.8 times of the diameter of the discharge frame surface 1120.

The above-described structure is for minimizing the heat transferred from the cover flange part 1910*a* to the frame flange 112. In detail, the cover flange part 1910*a* and the discharge frame surface 1120 may contact each other to cause the heat conduction. As described above, an amount of heat conducted through the heat conduction is proportional to an contact area.

Thus, the contact area between the cover flange part 1910*a* and the discharge frame surface 1120 may be minimized to minimize the amount of heat to be conducted. That is, an area of the cover flange part 1910*a* may be minimized to minimize the contact area with the discharge frame surface 1120.

Thus, a relatively large portion of the discharge frame surface 1120 may be exposed to the inside of the shell 101. Here, the discharge frame surface 1120 may be divided into a surface contacting the cover flange part 1910*a* and a surface that does not contact the cover flange part 1910*a*.

For convenience of description, the surface contacting the cover flange part 1910*a* may be referred to as a frame coupling surface 1120*a*, and the surface that does not contact the cover flange part 1910*a* may be referred to as a frame heat dissipation surface 1120*b*. Here, the frame heat dissipation surface 1120*b* may be disposed outside the frame coupling surface 1120*a* in the radial direction.

The frame coupling surface 1120*a* may be a surface on which the frame 110 and the discharge cover 191*a* contact each other to cause heat conduction. That is, since a discharge refrigerant having a very high temperature flows through the discharge cover 191, heat of the discharge cover 191 is conducted to the frame 110 through the frame coupling surface 1120*a*. Here, since the conduction heat transfer is proportional to the contact area, the more the frame coupling surface 1120*a* is widened, the more an amount of heat to be conducted may increase.

The frame heat dissipation surface 1120*b* corresponds to a surface of the discharge frame surface 1120, which is exposed to the inside of the shell 101. That is, since the frame heat dissipation surface 1120*b* does not contact the discharge cover 191, heat may not be transferred to the discharge cover 191.

Also, the frame heat dissipation surface 1120*b* contacts the shell refrigerant to cause heat transfer. That is, the convection heat transfer to the frame 110 may occur through the frame heat dissipation surface 1220*b*. Here, the more an amount of heat to be transferred increases, the more the temperature of the frame 110 may decrease. Also, since the convection heat transfer is proportional to the contact area, the more the frame heat dissipation surface 1120*a* is widened, an amount of heat to be dissipated may increase.

In summary, the diameter of the cover flange part 1910*a* of FIGS. 6 and 7 is less than that of the cover flange part 1910 of FIGS. 4 and 5. Thus, the frame illustrated in FIGS. 4 and 5 may be exposed to the inside of the shell 101 rather than the frames illustrated in FIGS. 6 and 7.

That is, the frame illustrated in FIGS. 6 and 7 may be maintained at a lower temperature than that of the frame illustrated in FIGS. 4 and 5. Thus, a more less amount of heat to be transferred to the suction refrigerant may decrease to secure higher compression efficiency.

The cover flange part 1910*a* includes a flange coupling hole 1911*a* through which a coupling member to be coupled to the frame 110 passes. Here, the flange coupling hole 1911*a* protrudes from the cover flange part 1910*a* in the radial direction. That is to say, the cover flange part 1910*a* may be disposed inside the discharge coupling hole 1100 in the radial direction.

Also, an edge of the flange coupling hole 1911*a* may have a thickness greater than that of the cover flange part 1910*a* in the axial direction. It may be understood that the flange coupling hole 1911*a* is a portion to be coupled by the coupling member and is prevented from being damaged because relatively large external force is applied.

Through the above-described structure, the frame heat dissipation surface 1120*b* may be disposed outside the third sealing member insertion part 1121 in the radial direction. Also, it is understood that a discharge coupling hole 1100 is defined in the frame coupling surface 1120*a*, and a stator coupling hole 1102 is defined in the frame heat dissipation surface 1120*b*. Also, it is understood that a terminal insertion part 1104 is also defined in the frame heat dissipation surface 1120*b*.

Each of the chamber part 1915*a* and the support device fixing part 1917*a* may have a cylindrical outer appearance. The chamber part 1915*a* may extend forward from the cover flange part 1910*a* in the axial direction. A plurality of discharge spaces D through which the refrigerant flows may be defined in the chamber part 1915*a*. Particularly, the chamber part 1915*a* includes a partition sleeve 1916*a* that partitions the internal space of the chamber part 1915*a* into the plurality of plurality discharge spaces D.

Fixed coupling parts 1918*a* and 1919*a* to which the above-described second support device 180 is coupled are disposed on the support device fixing part 1917*a*. Also, the fixed coupling part includes a first fixed coupling part 1918*a* to which the discharge support part 181 is coupled and a second fixed coupling part 1919*a* to which a discharge spring (not shown) is installed.

The gasket 300*a* may be disposed on at least a portion at which the discharge frame surface 1120 and the cover flange part 1910*a* overlap each other. Here, the gaskets 300*a* may be provided at positions and in numbers corresponding to the flange coupling holes 1911*a* and the discharge coupling holes 1100. For example, the gaskets 300*a* may be provided in three that are spaced apart from each other at an angle of about 120 degrees in the circumferential direction.

Also, each of the gaskets 300*a* may have provided in a ring shape. In detail, a gasket through-hole 302*a* corresponding to the flange coupling hole 1911*a* and the discharge coupling hole 1100 is defined in the gasket 300*a*. That is, the gasket 300*a* may be provided in a shape that surrounds the flange coupling hole 1911*a* and the discharge coupling hole 1100.

The discharge cover 191*a*, the gasket 300*a*, and the frame 110 are laminated so that the flange coupling hole 1911*a*, the gasket through-hole 302*a*, and the discharge coupling hole 1100 are sequentially arranged downward in the axial direction. Also, since a coupling member passes through the flange coupling hole 1911*a*, the gasket through-hole 302*a*, and the discharge coupling hole 1100, the discharge cover 191*a*, the gasket 300*a*, and the frame 110 may be coupled to each other.

The passage guide 200*a* includes a first guide part 210*a* extending in the axial direction and a second guide part 220*a* extending inward from the first guide part 210*a* in the radial direction. That is to say, the first guide part 210*a* may extend along an inner surface of the shell 101, and the second guide part 220*a* may protrude from the inner surface of the shell 101.

As illustrated in FIG. 7, the passage guide 200*a* is disposed above the frame flange 112 in the axial direction. Particularly, the passage guide 200*a* functions to provide the passage for the refrigerant flowing along the surfaces of the cover flange part 1910*a* and the frame flange 112.

Hereinafter, the passage guide will be described in detail. For convenience of description, although the reference numerals are described as illustrated in FIGS. 4 and 5, the passage guide illustrated in FIGS. 6 and 7 are also applicable.

Figure 8:
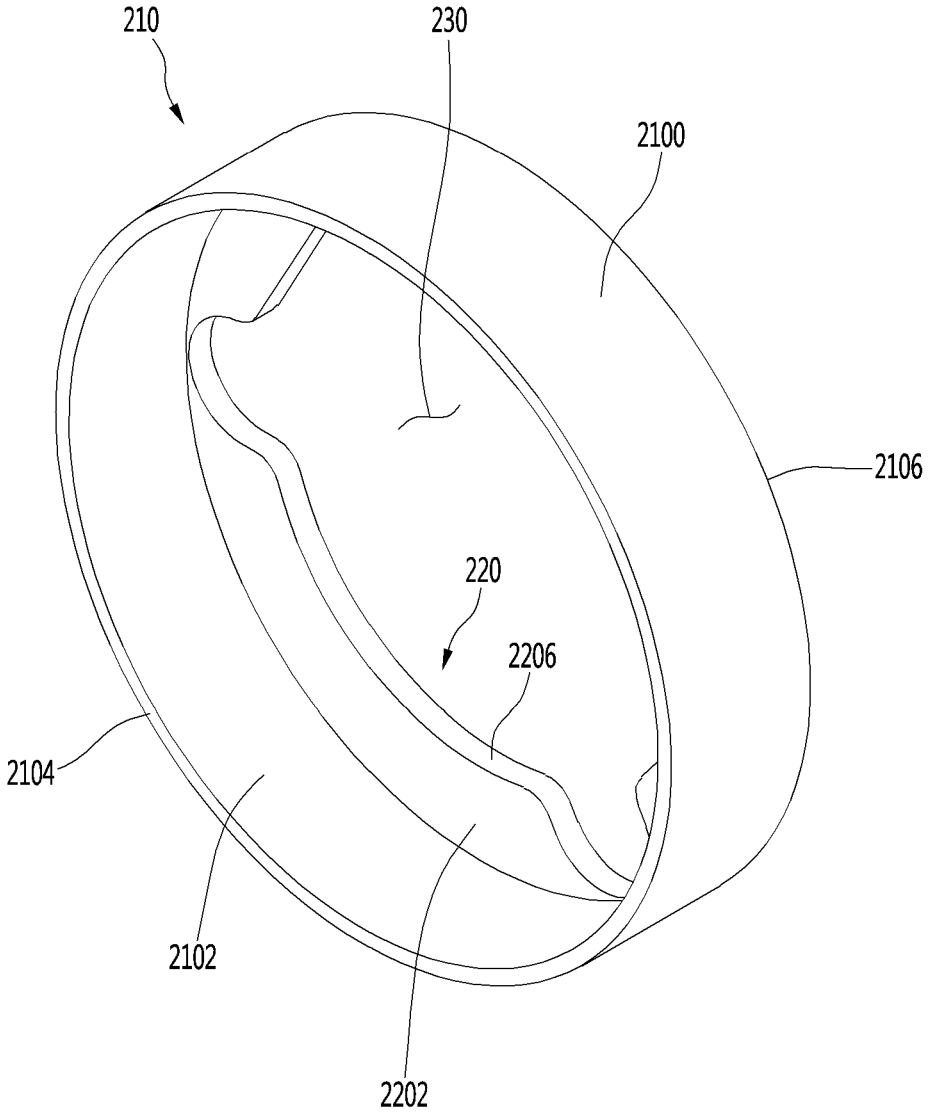
FIGS. 8 and 9 are views illustrating a passage guide of the linear compressor according to an embodiment.
Figure 9:
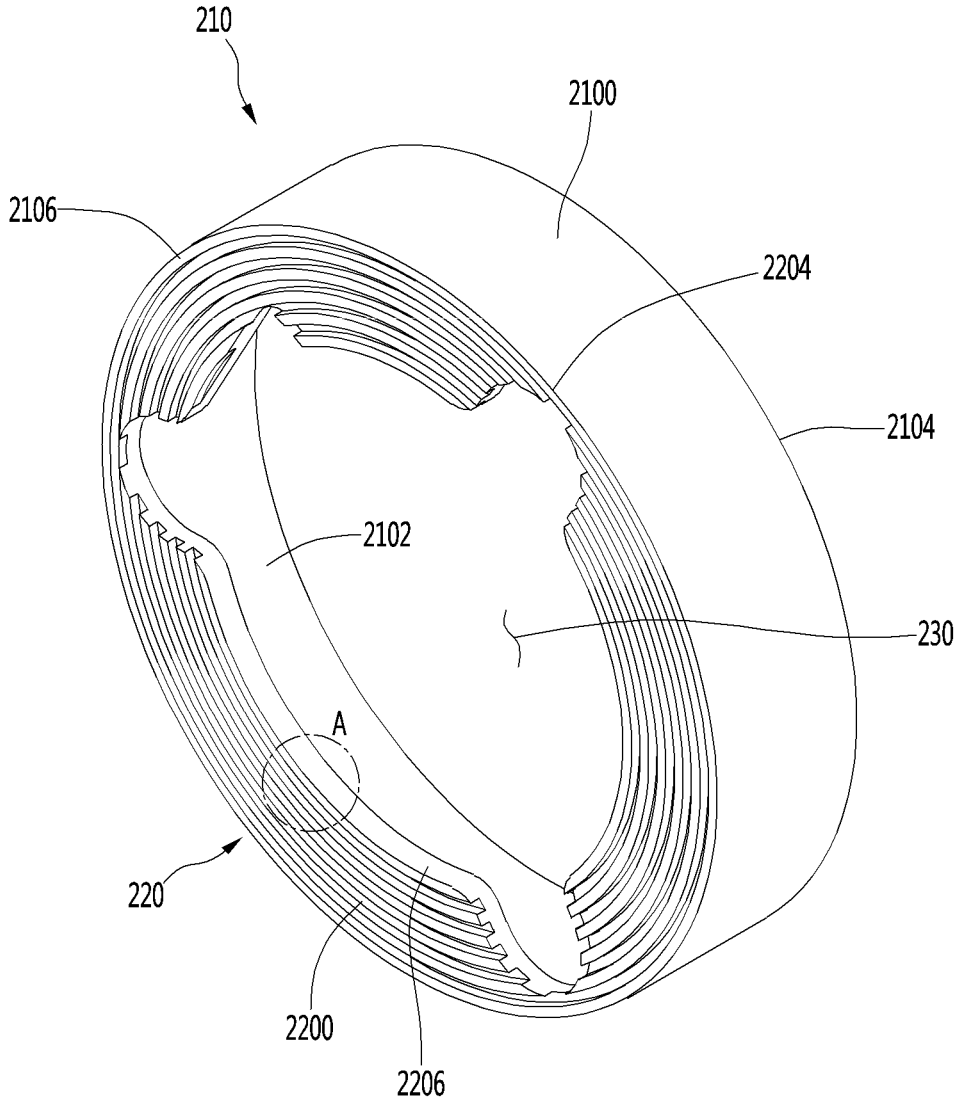

FIGS. 8 and 9 are views illustrating the passage guide of the linear compressor according to an embodiment.

As illustrated in FIGS. 8 and 9, the passage guide 200 includes the first guide part 210 and the second guide part 220.

The first guide part 210 extends along the inner surface of the shell 101 in the axial direction. Particularly, the first guide part 210 is disposed to contact the inner surface of the shell 101. In detail, the first guide part 210 has both opened ends and is provided in a cylindrical shape extending in the axial direction.

Here, respective surfaces of the first guide part 210 are defined a guide outer surface 2100, a guide inner surface 2102, a guide front end surface 2104, and a guide rear end surface 2106. The surfaces may be connected to each other.

The guide outer surface 2100 corresponds to a surface contacting the inner surface of the shell 101. That is, the guide outer surface 2100 may have a diameter corresponding to that of the inner surface of the shell 101. Also, an area of the guide outer surface 2100 may be understood as an area on which the passage guide 200 contacts the shell 101.

The guide inner surface 2102 corresponds to a surface opposite to the guide outer surface 2100 in the radial direction. Thus, the guide inner surface 2102 corresponds to a surface that is exposed along the inner surface of the shell 101.

In detail, the guide inner surface 2102 is disposed to protrude from the inner surface of the shell 101 by a distance spaced apart from the guide outer surface 2100. Here, a distance between the guide inner surface 2102 and the guide outer surface 2100 corresponds to a thickness of the first guide part 210.

The guide front end surface 2104 is disposed in front of the first guide part 210 in the axial direction. Also, the guide rear end surface 2106 is disposed in rear of the first guide part 210 in the axial direction. That is, the guide front end surface 2104 and the guide rear end surface 2106 may opposite to each other in the axial direction.

Here, a distance between the guide front end surface 2104 and the guide rear end surface 2106 corresponds to a length of the first guide part 210. The first guide part 210 has a length greater than a thickness thereof. That is, the first guide part 210 extends in the axial rather than the radial direction.

However, the above-described shape of the first guide part 210 is for contacting the shell 101, but is not limited thereto. Particularly, the more the length of the first guide part 210 increases, the more the contact area with the shell 101 may increase so that the first guide part 210 is more well coupled. Also, the more the thickness of the first guide part 210 decrease, the more the distance protruding from the inner surface of the shell 101 may decrease to prevent an interference with other constituents.

The second guide part 220 extends inward from the inner surface of the shell 101 in the radial direction. Particularly, the second guide part 220 extends inward from opened one end of the first guide part in the radial direction.

For example, the second guide part 220 may extend inward from the rear end surface 2106 in the radial direction. Also, the second guide part 220 has a guide through-hole 230.

Here, respective surfaces of the second guide part 220 are defined as a guide rear surface 2200, a guide front surface 2202, a guide outer end surface 2204, and a guide inner end surface 2206. The surfaces may be connected to each other.

The guide rear surface 2200 corresponds to a surface bent to extend inward from the guide outer surface 2100 in the radial direction. Also, the guide rear surface 2200 corresponds to a surface extending from the guide rear end surface 2106. Here, the guide rear end surface 2106 may be understood as a portion of the guide rear surface 2200.

The guide front surface 2202 corresponds to a surface opposite to the guide rear surface 2200 in the axial direction. In detail, the guide front surface 2202 is disposed in front of the guide rear surface 2200 in the axial direction.

Also, the guide front surface 2202 may be understood as a surface extending from the guide inner surface 2102. Here, a distance between the guide rear surface 2100 and the guide front surface 2102 corresponds to a thickness of the second guide part 220.

The guide outer end surface 2204 corresponds to a surface contacting the inner surface of the shell 101. Also, the guide outer end surface 2204 may be understood as a portion of the guide outer surface 2100.

The guide inner end surface 2206 corresponds to a surface opposite to the guide outer end surface 2204 in the radial direction. In detail, the guide inner end surface 2206 corresponds to a surface extending inward in the radial direction.

Also, the guide inner end surface 2106 may be understood as an edge of the through-hole 230. That is, the guide inner end surface 2106 may extend in the circumferential direction to define the guide through-hole 230.

Also, the guide inner end surface 2206 may be rounded. Particularly, the guide inner end surface 2206 may have a shape that prevents an eddy of a refrigerant flowing along the passage defined by the passage guide 200 from occurring. That is, the guide inner end surface 2206 may have various shapes according to the design.

Here, a distance between the guide outer end surface 2204 and the guide inner end surface 2206 corresponds to a length of the second guide part 220.

Thus, the passage guide 200 may extend in the axial direction and have a cross-section that extends or protrudes inward in the radial direction. Also, the front side of the passage guide 220 may be opened by the guide front end surface 2104, and the rear side of the passage guide 220 may be opened by the guide through-hole 2200.

Hereinafter, the passage guide of the linear compressor according to the first embodiment will be described in detail with reference to FIG. 5. The passage guide 200 is installed so that the second guide part 220 is disposed above the cover flange part 1910.

In detail, the passage guide 200 may be installed so that a predetermined passage is defined between the guide rear surface 2200 and the cover flange part 1910. Here, the passage may have a relatively narrow width. For example, the passage may have a width less than a thickness of the first guide part 210 or the second guide part 220.

As described above, the refrigerant may pass through the passage to increase in flow rate and convection heat transfer amount. Thus, the heat of the cover flange part 1910 may be effectively dissipated. Therefore, an amount of heat transferred to the frame flange 112 contacting the cover flange part 1910 may be reduced.

Particularly, heat transferred from the cover flange part 1910 to the shell refrigerant may be absorbed to the second guide part 220. Thus, the heat may be more effectively released from the cover flange part 1910 to the shell refrigerant. The above-described heat absorption of the passage guide will be described in detail.

Also, the passage guide 200 may serve as a stopper. In detail, a moving distance of the compressor body may be limited by a spaced distance between the passage guide 200 and the cover flange part 1910. For example, when the linear compressor 10 moves, the compressor body may be shaken due to an external impact or the like. Here, the cover flange part 1910 may contact the passage guide 200 and may be not vibrated any more.

Particularly, the spaced distance between the passage guide 200 and the cover flange part 1910 corresponds to a relatively narrow distance corresponding to the width of the passage. Thus, the moving distance of the compressor body may be effectively limited to prevent the compressor body from being damaged.

The second guide part 220 may extend to a lower surface of the chamber part 1913 connected to the cover flange part 1910. Thus, the guide inner end surface 2206 may be spaced a predetermined distance from the outer surface of the chamber part 1913.

Here, the spaced distance may decrease to improve the convection heat transfer effect that is described above. For example, the passage may have a spaced distance less than the thickness of the first guide part 210 or the second guide part 220.

The guide through-hole 230 may have a shape corresponding to that of the outer surface of the chamber part 1913. That is, the second guide part 220 may extend in the radial direction so as to be spaced a predetermined distance from the outer surface of the chamber part 1913. Thus, the second guide part 220 may be disposed to cover an upper side of the cover flange part 1910 that extends outward from the chamber part 1913 in the radial direction.

The guide front end surface 2104 may be disposed in rear of the flange protrusion 1913 in the axial direction. In detail, the guide front end surface 2014 may be disposed in rear of the portion that protrudes most radially outward from the flange protrusion 1913. This is done for avoiding an interference with the flange protrusion 1913.

Also, when the flange protrusion 1913 is omitted, and the discharge cover 191 is provided, the guide front end surface 2104 is not limited in position. That is, the first guide part 210 is not limited in length. For example, the guide front end surface 2204 may be enough to be disposed outside the chamber part 1913.

In summary, the first guide part 210 is installed to contact the inner surface of the shell 101 corresponding to the outside of the chamber part 1913. Also, the second guide part 220 is disposed to cover the front side of the cover flange part 1910. Thus, the second guide part 220 may absorb the heat of the refrigerant while increasing in flow rate, and the first guide part 210 may release the heat through the shell 101.

Hereinafter, the passage guide of the linear compressor according to the second embodiment will be described in detail with reference to FIG. 7. The passage guide 200 is installed so that the second guide part 220 is disposed above the discharge frame surface 1120.

For example, the second guide part 220 is disposed above the discharge frame surface 1120 so that the guide rear surface 2200 is disposed in the same line as the cover flange part 1919*a* in the radial direction. In another, the guide rear surface 2220 may extend in the radial direction along a plane defined by the cover flange part 1919*a*. Particularly, the second guide part 220 is disposed above the frame heat dissipation surface 1120*b*.

In detail, the passage guide 200 may be installed so that a predetermined passage is defined between the guide rear surface 2200 and the frame heat dissipation part 1910. Here, the passage may have a relatively narrow width. For example, the passage may have a width less than a thickness of the first guide part 210 or the second guide part 220.

As described above, the refrigerant may pass through the passage to increase in flow rate and convection heat transfer amount. Thus, the frame heat dissipation surface 1120*b* may effectively dissipate heat. Here, the heat may be effectively released from the frame 110 to obtain a more large effect.

Particularly, the heat transferred from the frame heat dissipation surface 1120*b* to the shell refrigerant may be absorbed to the second guide part 220. Thus, the frame heat dissipation surface 1120*b* may more effectively dissipate heat.

That is, as the cover flange part 1910*a* is minimized, the frame heat dissipation surface 1120*b* may be maximized to minimize the heat conducted from the discharge cover 191*a*. In addition, an amount of heat released from the frame heat dissipation surface 1120*b* through the convection may be maximized through the passage guide 200. As a result, an amount of heat transferred to the piston 130 may be minimized to maximize the compression efficiency.

Also, the passage guide 200 may serve as a stopper. In detail, a moving distance of the frame 110 may be limited by a spaced distance between the passage guide 200 and the frame flange 112. For example, when the linear compressor 10 moves, the compressor body may be shaken due to an external impact or the like. Here, the frame 110 may contact the passage guide 200 so as not to vibrate any longer.

Also, the second guide part 220 may extend adjacent to the outer surface of the cover flange part 1910*a*. Thus, the guide inner end surface 2206 may be spaced a predetermined distance from the outer surface of the cover flange part 1910*a*.

Here, the spaced distance may decrease to improve the convection heat transfer effect that is described above. For example, the passage may have a spaced distance less than the thickness of the first guide part 210 or the second guide part 220.

The guide through-hole 230 may have a shape corresponding to that of the outer surface of the cover flange part 1910*a*. That is, the second guide part 220 may extend in the radial direction so as to be spaced a predetermined distance from the outer surface of the cover flange part 1910*a*. Thus, the second guide part 220 may be disposed to cover an upper side of the frame heat dissipation surface 1120*b* disposed outside the cover flange part 1910*a* in the radial direction.

That is, the second guide part 220 may extend along the frame heat dissipation surface 1120*b*.

In summary, the first guide part 210 is installed to contact the inner surface of the shell 101 corresponding to the outside of the cover flange part and of the chamber part 1915*a*. Also, the second guide part 220 is disposed to cover a front side of the frame heat dissipation surface 1120*b*. Thus, the second guide part 220 may absorb the heat of the refrigerant while increasing in flow rate, and the first guide part 210 may release the heat through the shell 101.

Also, in this structure, the frame coupling surface 1120*a* corresponds to a surface contacting the discharge cover 191*a*, and the frame heat dissipation surface 1120*b* corresponds to a surface contacting the passage guide 200. Particularly, the frame coupling surface 1120*a* is coupled to contact the discharge cover 191*a*, and the frame heat dissipation surface 1120*b* is disposed to be spaced apart from the passage guide 200.

Here, a passage through which the shell refrigerant flows may be defined between the frame heat dissipation surface 1120*b* and the passage guide 200. Also, a passage communicating with the passage defined between the frame heat dissipation surface 1120*b* and the passage guide 200 may be defined between th second guide part 220 and the discharge cover 191*a*.

As described above, the shape of the guide through-hole 230, the length of the first guide part 210, and the length of the second guide part 220 may vary according to the arrangement of the passage guide. However, this is merely an example. Thus, the shape of the passage guide is not limited thereto.

As described above, the passage guide 200 may serve to absorb the heat of the shell refrigerant. Particularly, the second guide part 220 may serve to absorb the heat from the shell refrigerant. Also, the first guide part 210 may receive the heat from the second guide 220 to release the heat to the shell 101.

Thus, the second guide part 210 may be provided to more effectively absorb the heat of the refrigerant. Hereinafter, the passage guide 200 for effectively absorbing heat according to various embodiments will be described.

Figure 10A:
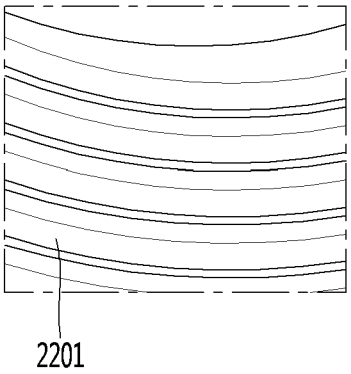
FIGS. 10A to 10C are views illustrating various examples of a portion A of FIG. 9.
Figure 10B:
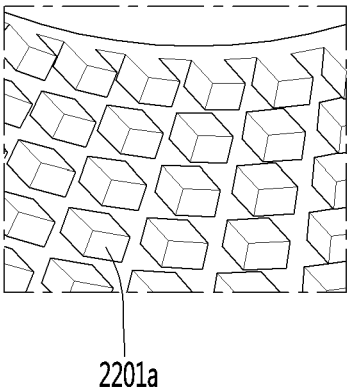
Figure 10C:
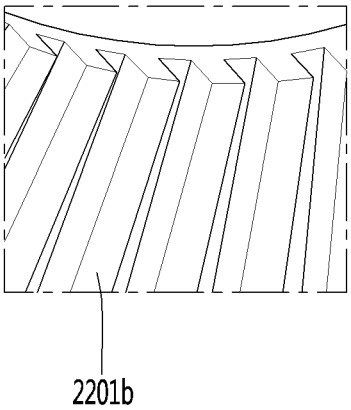

FIGS. 10A to 10C are views illustrating various examples of a portion A of FIG. 9.

Referring to FIG. 9, an uneven structure may be provided on the guide rear surface 2200. In detail, a plurality of protrusions 2201 protruding backward in the axial direction may be disposed on the guide rear surface 2200. Here, the plurality of protrusions 2201 may be understood as heat-exchange fins for more effective heat-exchange.

Particularly, the plurality of protrusions 2201 may allow the guide rear surface 220 to increase in surface area. Thus, a heat-exchange area with the shell refrigerant passing through the guide rear surface 220 may increase, and thus, an amount of heat to be heat-exchanged may increase.

Hereinafter, the plurality of protrusions 2201 may have various shapes. Here, each embodiment is distinguished by adding 'a' or 'b' to the reference numerals. Also, the shape of each of the protrusions is illustrative and not restrictive.

FIG. 10A illustrates a portion of the guide rear surface 2200 of the passage guide 200 of FIG. 9. As illustrated in FIG. 10A, the plurality of protrusions 2201 may extend in the circumferential direction and be spaced apart from each other in the radial direction. Thus, one protrusion 2201 may have a circular shape.

FIG. 10B illustrates a modified example of the portion of the guide rear surface 2200 of the passage guide 200 of FIG. 9. As illustrated in FIG. 10B, a plurality of protrusions 2201*a* may be spaced apart from each other in the circumferential direction the radial direction. Thus, one protrusion 2201*a* may have a pin shape.

FIG. 10C illustrates another modified example of the portion of the guide rear surface 2200 of the passage guide 200 of FIG. 9. As illustrated in FIG. 10C, a plurality of protrusions 2201*b* may extend in the radial direction and be spaced apart from each other in the circumferential direction. Thus, one protrusion 2201*a* may have a rod shape that extends in the radial direction.

Also, the passage guide 200 may be made of a material having a high heat transfer coefficient. Particularly, the passage guide 200 may be made of a material having a heat transfer coefficient greater than that of each of the frame 110 and the discharge cover 191. For example, the passage guide 200 may be made of a porous material having a pore structure.

Thus, heat of the shell refrigerant may be more well absorbed. Also, a surface of the passage guide 200 may be heat-dissipation coated to more effectively absorb heat.

Through the above-described various structures, the passage guide 200 may more effectively absorb the heat of the shell refrigerant. Also, the above description is illustrative. For example, the passage guide 200 may have various shapes and be made of various materials.

As described above, the passage guide 200 is installed to contact the inner surface of the shell 101. However, in the above-described arrangement, the passage guide 200 may move or rotate within the shell 101 while the linear compressor 10 is driven.

Thus, the passage guide 200 may be provided with a structure for fixing the shell 101. Hereinafter, the passage guide 200 provided to be fixed to the shell 101 according to various embodiments will be described.

Figure 11:
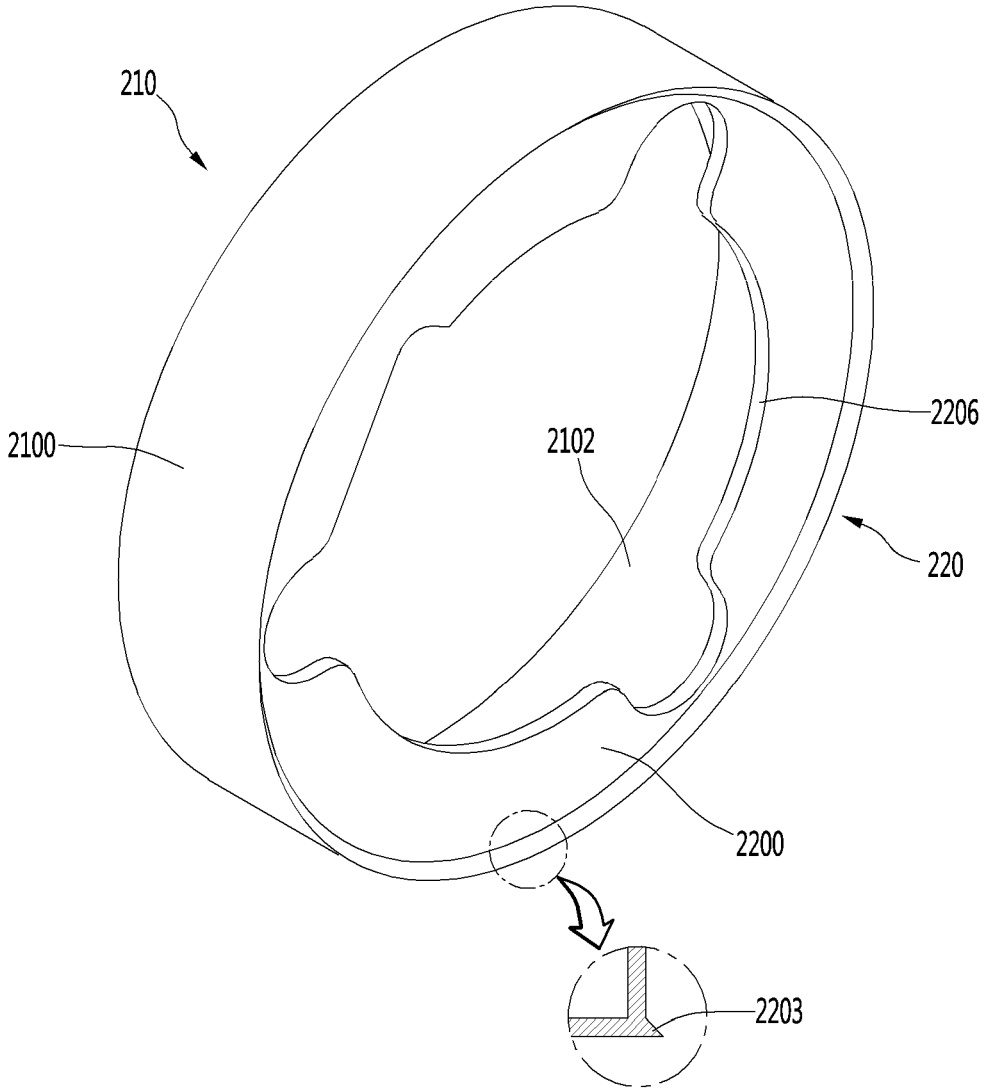
FIGS. 11 to 13 are views illustrating a passage guide of a linear compressor according to another embodiment.
Figure 12:
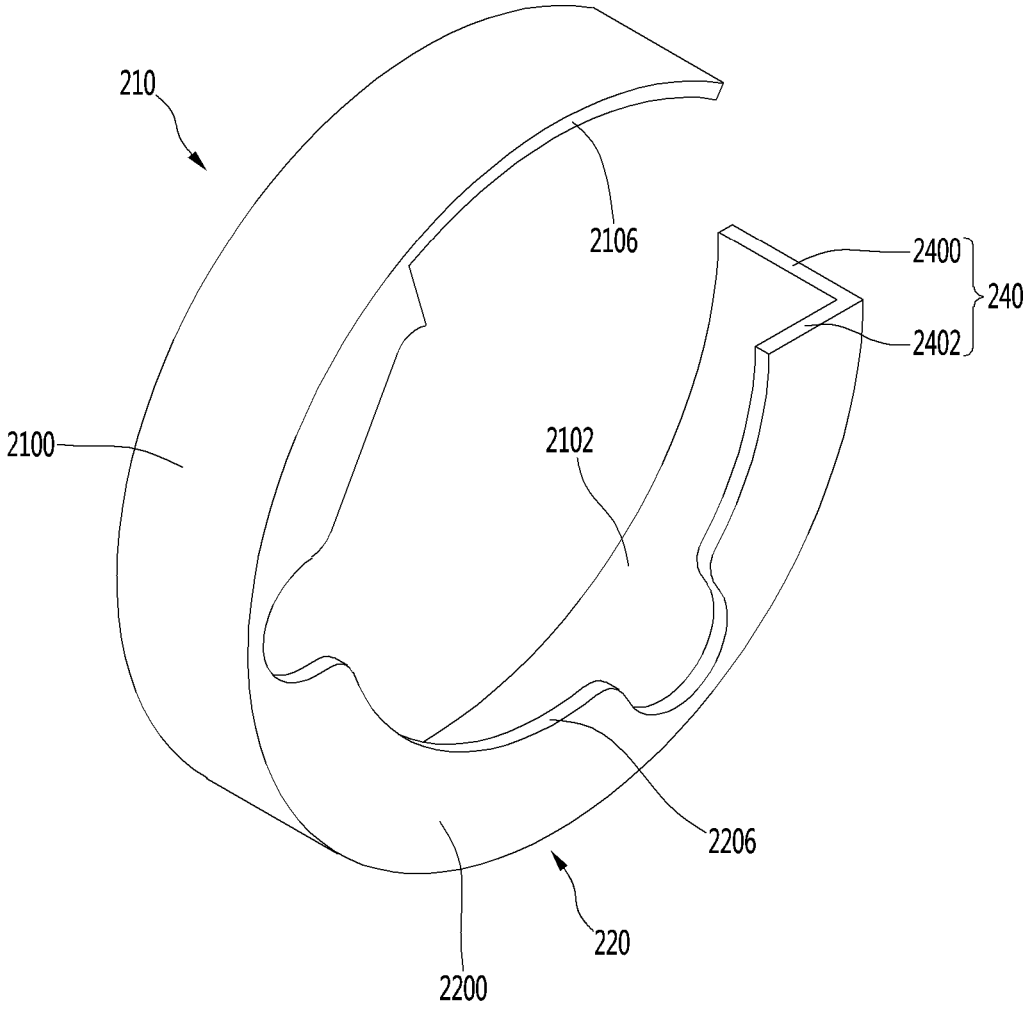
Figure 13:
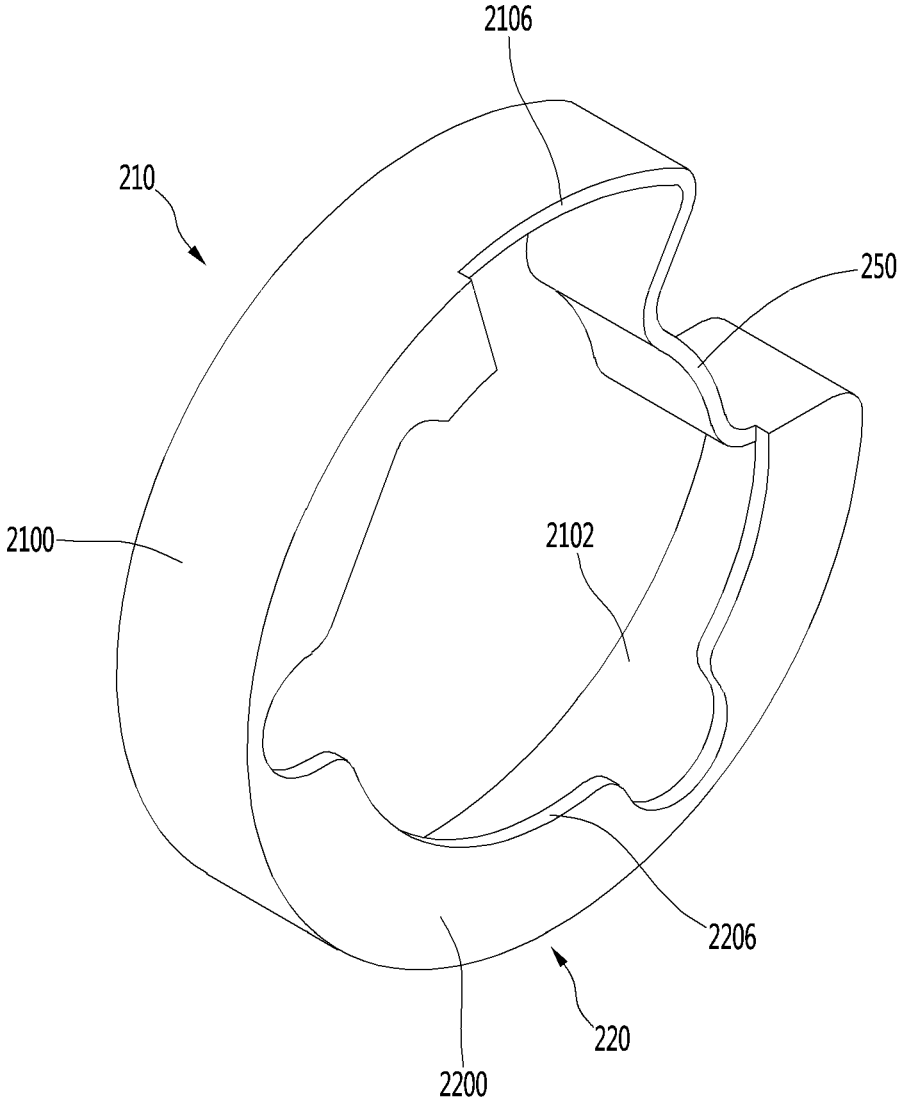

FIGS. 11 to 13 are views illustrating a passage guide of a linear compressor according to another embodiment.

As illustrated in FIG. 11, a fixed protrusion 2203 protruding outward in a radial direction is provided on a passage guide 200. In detail, the fixed protrusion 2203 may extend outward in the radial direction along a guide rear surface 2200. Particularly, a guide outer end 2204 may protrude outward in the radial direction to provide the fixed protrusion 2203.

Particularly, the fixed protrusion 2203 protrudes outward from a guide outer surface 2100 in the radial direction. That is, the fixed protrusion 2203 may protrude outward from an inner surface of a shell 101 in the radial direction.

Thus, a fixing insertion groove (not shown) into which the fixed protrusion 2203 is inserted may be defined in the inner surface of the shell 101. Thus, the passage guide 200 may be installed so that the fixed protrusion 2203 is inserted into the fixing insertion groove (not shown). Here, the position of the passage guide 200 may be accurately installed.

Also, an extending end of the fixed protrusion 2203 may be a tip part. Also, the fixed protrusion 2203 may be made of an elastic material to contact the inner surface of the shell 101.

As illustrated in FIG. 12, a cut part 240 is provided on the passage guide 200. The cut part 240 is provided on one side of the passage guide 200.

In detail, a side surface of a first guide part 210 may have a close curve by the cut part 240. Thus, a first cut surface 2400 may be disposed on the first guide part 210. The first cut surface 2400 may have a shape corresponding to a cross-section of the first guide part 210.

The first cut surface 2400 may be provided in a pair. The pair of first cut surfaces 2400 may be disposed to be spaced apart from each other in a circumferential direction. That is, the first guide part 210 has a cylindrical shape of which an outer surface is cut at a predetermined angle in the circumferential direction.

A second guide part 220 may extend from only at least a portion of the first guide part 210 by the cut part 240. Thus, the first guide part 210 may provide at least a portion of a guide through-hole 230. That is, the guide through-hole 230 may have one side that is opened by the cut part 240.

A second cut surface 2402 may be disposed on the second guide part 220. The second cut surface 2402 may have a shape corresponding to a cross-section of the second guide part 220. Also, the second cut surface 2402 may be provided in a pair. The pair of second cut surfaces 2402 may be disposed to be spaced apart from each other in a circumferential direction.

Here, the second cut surfaces 2402 may be disposed to be spaced apart from each other at an angle greater than the spaced angle of the first cut surfaces 2400. That is, the second guide part 220 may be cut at an angle greater than the cut angle of the first guide part 210.

As described above, the cut part 240 may correspond to a relatively easily deformable structure when the passage guide 200 is installed on the inner surface of the shell 101.

In detail, the passage guide 200 may be inserted into the shell 101 by applying external force by which the first cut surfaces 2400 approach each other. Also, when the external force is removed, the passage guide 200 may be fixed to the inner surface of the shell 101 by elastic force by which the first surfaces 2400 are away from each other.

Here, the guide outer surface 2100 may have a diameter greater than that of the inner surface of the shell 101. Thus, the passage guide 200 may be more well fixed to the inner surface of the shell 101.

As illustrated in FIG. 13, a recess part 250 is provided in the passage guide 200. The recess part 250 is provided in one side of the passage guide 200.

The recess part 250 corresponds to a portion that is recessed inward in the radial direction. Particularly, the recess part 250 may be understood as a portion of the first guide part 210. Also, a second guide part 220 may not be provided on the portion in which the recess part 250 is provided.

Like the cut part 240, the recess part 250 may correspond to a relatively easily deformable structure when the passage guide 200 is installed on the inner surface of the shell 101.

In detail, the passage guide 200 may be inserted into the shell 101 by applying external force by which the recess part 250 moves inward in the radial direction. Also, when the external force is removed, the passage guide 200 may be fixed to the inner surface of the shell 101 by elastic force by which the recess part 250 returns to its original position.

Here, the guide outer surface 2100 may have a diameter greater than that of the inner surface of the shell 101. Thus, the passage guide 200 may be more well fixed to the inner surface of the shell 101.

Also, as described above, the cut part 240 and the recess part 250 may be provided to avoid an interference with internal constituents of the shell 101. That is, the passage guide 200 may be provided in various shapes.

The linear compressor including the above-described constituents according to the embodiment may have the following effects.

The passage guide configured to minimize the heat-exchange between the shell refrigerant accommodated in the shell and the discharge cover or the frame may be installed. Thus, the discharge cover or the frame may effectively release the heat to the shell refrigerant.

Particularly, the passage guide may allow the shell refrigerant flowing along the surface of the discharge cover or the frame to increase in flow rate, thereby maximizing the convection heat transfer.

Also, the heat of the piston and the cylinder in which the suction refrigerant is accommodated may be released to the outside through the frame to minimize the heat transferred from the piston and the cylinder to the suction refrigerant and reduce the temperature of the suction refrigerant, thereby improving the compression efficiency.

Also, the surface area of the frame, which is covered by the discharge cover, may be minimized to reduce the heat transfer from the discharge cover to the frame. Also, the area of the frame, which is exposed to the shell refrigerant, may increase, and thus, the convection heat transfer to the refrigerant within the shell may increase.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a shell that defines an internal space therein;

a first shell cover coupled to a rear end of the shell;

a second shell cover coupled to a front end of the shell;

a compressor body disposed in the internal space of the shell, the compressor body comprising:

a cylinder, a frame that accommodates at least a portion of the cylinder, and a discharge cover coupled to a front surface of the frame, a front end of the discharge cover facing the second shell cover; and a passage guide disposed between the front surface of the frame and the front end of the discharge cover, the passage guide dividing the internal space of the shell into (i) a first space between the second shell cover and the passage guide and (ii) a second space between the passage guide and the first shell cover, wherein the passage guide comprises:

a first guide part that extends along an inner surface of the shell in an axial direction of the shell, and a second guide part that extends from the first guide part toward the discharge cover in a radial direction of the shell, and wherein a first passage is defined between an inner end of the second guide part and the discharge cover, the first passage being configured to allow refrigerant in the first space to flow toward the second space to thereby dissipate heat from the frame.

2. The linear compressor according to claim 1, wherein a portion of the second guide part overlaps with the front surface of the frame along the axial direction.

3. The linear compressor according to claim 2, wherein the discharge cover comprises:

a cover flange part coupled to the front surface of the frame; and a chamber part that extends from the cover flange part toward the second shell in the axial direction, wherein the first guide part is disposed out of the chamber part or outside of the cover flange part in the radial direction, and wherein the second guide part is disposed between the second shell cover and the front surface of the frame.

4. The linear compressor according to claim 3, wherein the second guide part comprises a guide rear surface that faces the first shell cover, and wherein the guide rear surface extends in the radial direction along a plane defined by the cover flange part.

5. The linear compressor according to claim 4, wherein the guide rear surface and the front surface of the frame are spaced apart from each other to thereby define a second passage between the guide rear surface and the front surface of the frame, the second passage being configured to allow the refrigerant having passed through the first passage to flow to the second space, and wherein a width of the second passage is less than a thickness of the first guide part in the radial direction or a thickness of the second guide part in the axial direction.

6. The linear compressor according to claim 5, wherein the passage guide further comprises a plurality of protrusions that protrude from the guide rear surface in the axial direction.

7. The linear compressor according to claim 4, wherein the second guide part comprises a guide inner end surface that faces the cover flange part, and wherein the guide inner end surface and the cover flange part are spaced apart from each other to thereby define the first passage, and wherein a distance between the guide inner end surface and the cover flange part is less than a thickness of the first guide part in the radial direction or a thickness of the second guide part in the axial direction.

8. The linear compressor according to claim 7, wherein the guide inner end surface defines a guide through-hole that receives the discharge cover, the guide through-hole having a shape corresponding to an outer contour of the cover flange part in the radial direction.

9. The linear compressor according to claim 3, wherein the second guide part comprises:

a guide inner end surface that extends toward the chamber part; and a guide rear surface that extends from the guide inner end surface in the radial direction and that is disposed between the second shell cover and a rear surface of the cover flange part, the rear surface of the cover flange part being in contact with the front surface of the frame.

10. The linear compressor according to claim 9, wherein the guide inner end surface defines a guide through-hole that receives the discharge cover, the guide through-hole having a shape corresponding to an outer contour of the cover flange part in the radial direction.

11. The linear compressor according to claim 1, wherein the first guide part comprises:

a guide outer surface that contacts the inner surface of the shell;

a guide inner surface that is disposed at an opposite side of the guide outer surface; and a guide front end surface that faces the second shell cover and connects together front ends of the guide outer surface and the guide inner surface, and wherein the second guide part extends from rear ends of the guide outer surface and the guide inner surface in the radial direction.

12. The linear compressor according to claim 11, wherein the passage guide further comprises a fixed protrusion that protrudes outward from the guide outer surface in the radial direction and that is inserted into the inner surface of the shell.

13. The linear compressor according to claim 1, wherein the first guide part of the passage guide and the discharge cover extend toward the second shell cover along the axial direction.

14. The linear compressor according to claim 13, wherein the front end of the discharge cover is disposed between the second shell cover and the passage guide.

15. A linear compressor comprising:

a shell having a cylindrical shape, the shell having a front opening and a rear opening that are spaced apart from each other in an axial direction of the shell;

a first shell cover that covers the rear opening of the shell;

a second shell cover that covers the front opening of the shell;

a cylinder that extends in the axial direction;

a piston disposed in the cylinder;

a frame that accommodates at least a portion of the cylinder;

a discharge cover that is coupled to the frame and that allows flow of compressed refrigerant therethrough, the discharge cover having a front end facing the second shell cover and a rear end coupled to the frame; and a passage guide disposed outside of the discharge cover in a radial direction of the shell and disposed between the second shell cover and the frame in the axial direction, wherein the frame comprises:

a frame body that accommodates at least the portion of the cylinder and extends toward the first shell cover, and a frame flange that extends from a front end of the frame body in the radial direction, the frame flange comprising a discharge frame surface that is coupled to the discharge cover and that is disposed at a front surface of the frame flange facing the second shell cover, wherein the discharge frame surface comprises:

a frame coupling surface that contacts the rear end of the discharge cover, and a frame heat dissipation surface that is defined outside of the frame coupling surface in the radial direction and that overlaps with the passage guide along the axial direction of the shell, and wherein the passage guide is disposed closer to the frame heat dissipation surface than to the front end of the discharge cover, the passage guide defining a refrigerant passage between the discharge cover and the frame heat dissipation surface.

16. The linear compressor according to claim 15, wherein the frame coupling surface is coupled to and contacts the rear end of the discharge cover, and wherein the frame heat dissipation surface and the passage guide are spaced apart from each other to define a first portion of the refrigerant passage.

17. The linear compressor according to claim 16, wherein the passage guide comprises:

a first guide part that extends in the axial direction and that is disposed outside of the discharge cover in the radial direction; and a second guide part that extends from the first guide part toward an outer surface of the discharge cover in the radial direction along the frame heat dissipation surface.

18. The linear compressor according to claim 17, wherein the second guide part and the outer surface of the discharge cover are spaced apart from each other in the radial direction to define a second portion of the refrigerant passage that is fluidly connected to the first portion of the refrigerant passage.

19. The linear compressor according to claim 15, wherein the frame defines a discharge sealing member insertion part that is configured to receive a discharge sealing member and that is recessed rearward from the discharge frame surface in the axial direction, and wherein the frame heat dissipation surface is disposed outside the discharge sealing member insertion part in the radial direction.

20. The linear compressor according to claim 15, further comprising:

a motor assembly configured to drive the piston, wherein the frame defines:

a discharge coupling hole disposed at the frame coupling surface and configured to receive a coupling member that is configured to couple the discharge cover to the frame, and a stator coupling hole disposed at the frame heat dissipation surface and configured to receive a cover coupling member that is configured to couple to the motor assembly.

* * * * *